US012383026B2

(12) United States Patent
Nakamura et al.

(10) Patent No.: US 12,383,026 B2
(45) Date of Patent: Aug. 12, 2025

(54) SHOE SOLE AND SHOE

(71) Applicant: ASICS CORPORATION, Hyogo (JP)

(72) Inventors: Hiroki Nakamura, Hyogo (JP); Keishi Kitamoto, Hyogo (JP); Yuji Tamakoshi, Hyogo (JP); Seiji Yano, Hyogo (JP); Shingo Masumoto, Hyogo (JP); Shuhei Takemura, Hyogo (JP); Hiroaki Nishimura, Hyogo (JP); Naoki Sakajo, Hyogo (JP); Seigo Nakaya, Hyogo (JP); Kazunaga Nakayama, Hyogo (JP)

(73) Assignee: ASICS CORPORATION, Hyogo (JP)

( * ) Notice: Subject to any disclaimer, the term of this patent is extended or adjusted under 35 U.S.C. 154(b) by 47 days.

(21) Appl. No.: 17/360,035

(22) Filed: Jun. 28, 2021

(65) Prior Publication Data

US 2022/0015499 A1 Jan. 20, 2022

(30) Foreign Application Priority Data

Jul. 14, 2020 (JP) ..... 2020-120520

(51) Int. Cl.
*A43B 13/18* (2006.01)
*A43B 7/144* (2022.01)
(Continued)

(52) U.S. Cl.
CPC ..... *A43B 13/188* (2013.01); *A43B 7/144* (2013.01); *A43B 13/127* (2013.01); *A43B 13/02* (2013.01)

(58) Field of Classification Search
CPC ..... A43B 13/12; A43B 13/122; A43B 13/125; A43B 13/127; A43B 13/188; A43B 7/144
See application file for complete search history.

(56) References Cited

U.S. PATENT DOCUMENTS 4,364,188 A * 12/1982 Turner ..... A43B 5/06 36/31
4,625,435 A 12/1986 Ueda
(Continued)

FOREIGN PATENT DOCUMENTS

EP 0 096 542 A1 12/1983
JP S5990503 A 5/1984
(Continued)

OTHER PUBLICATIONS

Extended European Search Report issued Nov. 24, 2021 in corresponding European Application No. 21184579.7, filed Aug. 7, 2021.
(Continued)

*Primary Examiner* — Megan E Lynch
(74) *Attorney, Agent, or Firm* — Global IP Counselors, LLP

(57) ABSTRACT

A shoe sole includes a body portion and a heel holding portion. The heel holding portion is located opposite to a ground contact surface of the body portion and holds a heel portion of a foot at least from a medial foot side. The body portion includes a low hardness portion and a high hardness portion. The high hardness portion is a foam material harder than a foam material of the low hardness portion. The heel holding portion is a resin harder than the foam material of the low hardness portion and the foam material of the high hardness portion. On the medial foot side in a rear foot portion, the low hardness portion is located between the heel holding portion and the high hardness portion in an up-down direction.

20 Claims, 16 Drawing Sheets

(51) Int. Cl.
*A43B 13/12* (2006.01)
*A43B 13/02* (2022.01)

(56) References Cited

U.S. PATENT DOCUMENTS 4,854,055 A * 8/1989 Sugiyama ..... A43B 5/00 36/68
4,876,053 A * 10/1989 Norton ..... A43B 13/187 264/328.8
8,079,159 B1 * 12/2011 Rosa ..... A43B 7/142 36/31
8,863,407 B2 * 10/2014 Nishiwaki ..... A43B 13/141 36/27
2004/0154188 A1 * 8/2004 Laska ..... A43B 13/186 36/31
2007/0193065 A1 * 8/2007 Nishiwaki ..... A43B 21/265 36/35 B
2007/0295451 A1 * 12/2007 Willis ..... A43B 9/16 36/43
2009/0013556 A1 * 1/2009 Nishiwaki ..... A43B 13/181 36/28
2009/0113758 A1 * 5/2009 Nishiwaki ..... A43B 13/10 36/28
2010/0287792 A1 * 11/2010 Hide ..... A43B 5/10 36/114
2011/0185590 A1 * 8/2011 Nishiwaki ..... A43B 13/187 36/28
2011/0197469 A1 * 8/2011 Nishiwaki ..... A43B 13/186 36/28
2013/0074371 A1 * 3/2013 Borel ..... A43B 7/142 36/102
2018/0084864 A1 3/2018 Takada et al.
2018/0263335 A1 * 9/2018 Iuchi ..... A43B 13/122

FOREIGN PATENT DOCUMENTS

JP S60145808 U 9/1985
JP S63118807 U 8/1988
JP 5875168 B1 3/2016
JP 2016-59555 A 4/2016
WO 2006/120749 A1 11/2006
WO 2007/122722 A1 11/2007
WO 2010/038266 A1 4/2010
WO 2010/049983 A1 5/2010

OTHER PUBLICATIONS

Japanese Office Action issued Feb. 27, 2024 in corresponding Japanese Application No. 2020-120520.

* cited by examiner

SHOE SOLE AND SHOE

CROSS-REFERENCE TO RELATED APPLICATION

This non-provisional application claims priority to Japanese Patent Application No. 2020-120520 filed on Jul. 14, 2020 with the Japan Patent Office, the entire contents of which are hereby incorporated by reference.

BACKGROUND

Field of the Invention

The present invention relates to a shoe sole and a shoe.

Background Information

Documents disclosing a shoe sole and a shoe include Japanese Patent Laying-Open No. 2016-59555, WO2006/120749, WO2007/122722, WO2010/038266, Japanese Patent No. 5875168, and WO2010/049983.

Japanese Patent Laying-Open No. 2016-59555 discloses a shoe sole including a midsole that has a rear end region, an inner region, and an outer region. The rear end region supports an inner rear end and an outer rear end of a foot including the lower end of the heel bone. In a part or the entirety of the rear end region, a lower layer and an upper layer are stacked on top of each other. The upper layer has less compression rigidity than the lower layer.

WO2006/120749 discloses a shoe sole including a midsole, an outer sole, a deformation element, and a coupling member. The deformation element is disposed between the outer sole and the midsole. The deformation element has a bending deformation member that opens from the center of a rear foot portion toward its peripheral edge. The bending deformation member has a lower plate portion and an upper plate portion, between which a rubber-like or sheath-like compressive deformation member is mounted. When the compressive deformation member is compressed, it deforms while storing a bounce back force. The coupling member is interposed between the midsole and the bending deformation member. The coupling member couples the midsole and the bending deformation member to each other. The material of the coupling member is higher in Young's modulus than the material of the midsole and lower in Young's modulus than the material of the bending deformation member.

Conventional shoe soles include a shoe sole that mitigates impact upon the heel portion of a wearer of the shoe when the shoe sole hits the ground. For example, Japanese Patent Laying-Open No. 2016-59555 discloses that a flexible upper layer mitigates impact transmitted to the foot when the shoe sole hits the ground. WO2006/120749 discloses that the impact occurring when the shoe sole hits the ground is dispersed by a bending deformation member and further dispersed by a coupling member. WO2007/122722 discloses that bulging of each blade forms an arch that deforms to thereby improve the shock absorbing function of a rear foot portion. Further, WO2010/038266 discloses that a reinforcing member suppresses lowering of the arch of a foot.

On the other hand, conventional shoe soles also include a shoe sole that improves the stability of the foot of a wearer. Japanese Patent No. 5875168 discloses that the suppression of lateral shaking of a rear foot portion is significantly improved on the inner side and/or the outer side where a skirt is provided. WO2010/049983 discloses that an embedded portion suppresses pronation and an upper portion of the first region in a midsole body supports the sole of the foot, so that the sole of the foot is less likely to feel an upward thrust from below.

SUMMARY

However, when a conventional shoe sole hits the ground, the heel portion receives an impact, like an upward thrust, locally from below, through a member disposed on the shoe sole for improving the stability. In particular, in the case of a shoe sole that is designed to suppress overpronation, the above-mentioned members are relatively hard in order to enhance stability, so that such an impact is significant.

Embodiments of the present invention have been made in view of the above-described problems, and an object of embodiments of the present invention is to provide a shoe sole and a shoe that are capable of mitigating the local impact caused by the shoe sole hitting the ground and being transmitted to the heel portion of a wearer of the shoe through a stability improvement member, while suppressing overpronation to improve the stability of the foot.

A shoe sole according to embodiments of the present invention has: a front foot portion supporting a toe portion and a ball portion of a foot; a middle foot portion supporting an arch portion of the foot; and a rear foot portion supporting a heel portion of the foot, wherein the front foot portion, the middle foot portion, and the rear foot portion are connected in a foot length direction. The shoe sole includes a body portion and a heel holding portion. The body portion has a ground contact surface. The heel holding portion is located opposite to the ground contact surface of the body portion and holds the heel portion of the foot at least from a medial foot side. The body portion includes a low hardness portion and a high hardness portion. The low hardness portion is made of a foam material. The high hardness portion is located opposite to the heel holding portion when viewed from the low hardness portion. The high hardness portion is made of a foam material harder than the foam material of the low hardness portion. The heel holding portion is made of a resin that is harder than each of the foam material of the low hardness portion and the foam material of the high hardness portion. On the medial foot side in the rear foot portion, the low hardness portion is located between the heel holding portion and the high hardness portion in an up-down direction.

A shoe according to an embodiment of the present invention includes: the shoe sole according to the above-described present invention; and an upper located above the shoe sole.

The foregoing and other objects, features, aspects and advantages of the present invention will become more apparent from the following detailed description of embodiments of the present invention when taken in conjunction with the accompanying drawings.

BRIEF DESCRIPTION OF THE DRAWINGS

The invention will be explained in more detail hereinafter with reference to the drawings.

DETAILED DESCRIPTION

Figure 1:
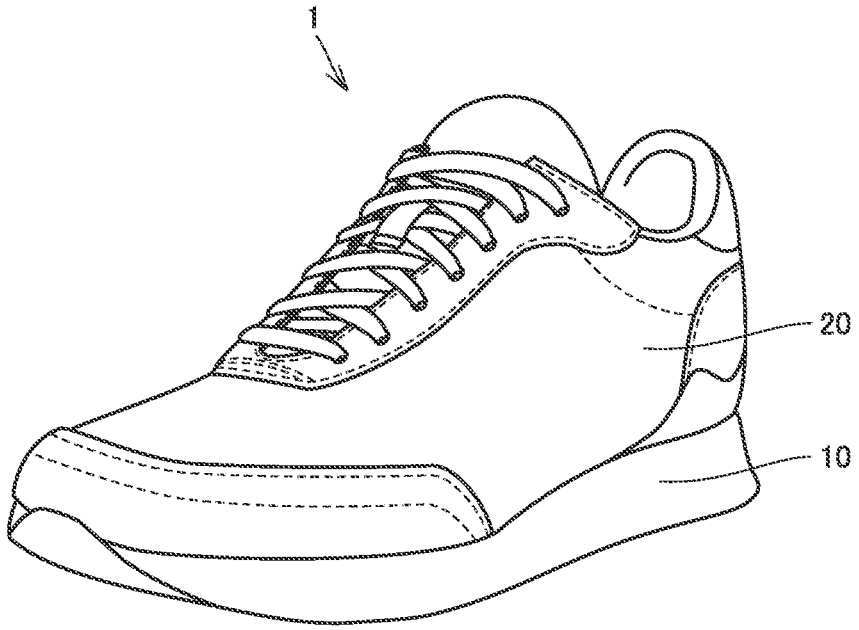
FIG. 1 is a schematic perspective view of a shoe according to one embodiment of the present invention.

The following describes a shoe sole and a shoe according to one embodiment of the present invention with reference to the accompanying drawings. In the following description of the embodiments, the same or corresponding portions in the accompanying drawings are denoted by the same reference characters, and the description thereof will not be repeated. In the following description of the embodiments, terms such as "front" or "forward", "rear" or "rearward", "above" or "upward", and "below" or "downward" will be used. The terms such as "front" or "forward" and "rear" or "rearward" refer to directions viewed from a wearer who wears shoes placed on a flat surface such as the ground. For example, the term "front" or "forward" refers to a toe side, and the term "rear" or "rearward" refers to a heel side. The term "below" or "downward" refers to a direction toward the ground with respect to a shoe placed on a flat surface such as the ground. The term "above" or "upward" refers to a direction opposite to the ground side.

FIG. 1 is a schematic perspective view of a shoe according to one embodiment of the present invention. As shown in FIG. 1, a shoe 1 according to one embodiment of the present invention includes a shoe sole 10 and an upper portion 20 located above the shoe sole 10. The upper portion 20 is connected to shoe sole 10 and forms a space together with the shoe sole 10, in which a foot is accommodated. The upper portion 20 may or may not have an insole that forms a lower part of the upper portion 20.

Figure 2:
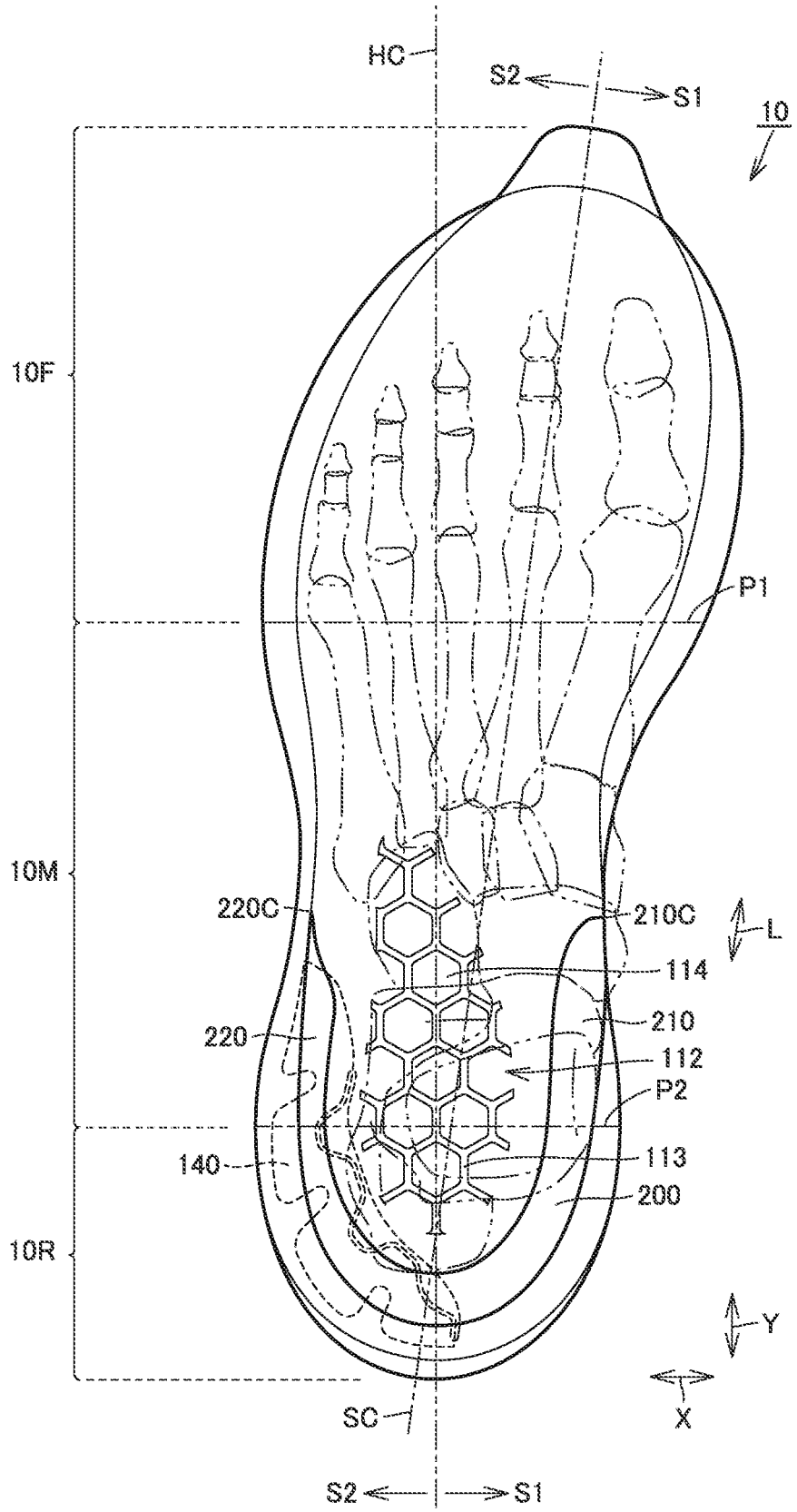
FIG. 2 is a plan view of a shoe sole according to one embodiment of the present invention, when seen from above.

FIG. 2 is a plan view of a shoe sole according to one embodiment of the present invention, when seen from above. In FIG. 2, a two-dot chain line shows the bones of a foot of a standard wearer who is wearing the shoe 1 having the shoe sole 10. As shown in FIG. 2, the shoe sole 10 according to one embodiment of the present invention includes: a front foot portion 10F for supporting a toe portion and a ball portion of a foot; a middle foot portion 10M for supporting an arch portion of the foot; and a rear foot portion 10R for supporting a heel portion of the foot. The front foot portion 10F, the middle foot portion 10M, and the rear foot portion 10R are connected in a foot length direction Y.

The front foot portion 10F includes a front end of the shoe sole 10. The rear foot portion 10R includes a rear end of the shoe sole 10. In the present embodiment, a first boundary position P1 as a boundary position between the front foot portion 10F and the middle foot portion 10M is a position located at 40% of the dimension of the shoe sole 10 from its front end in the foot length direction Y. A second boundary position P2 as a boundary position between the middle foot portion 10M and the rear foot portion 10R is a position located at 80% of the dimension of the shoe sole 10 from its front end in the foot length direction Y. The first boundary position P1 and the second boundary position P2 extend in a foot width direction X.

In the present embodiment, the foot width direction X is perpendicular to the foot length direction Y when the shoe sole 10 is viewed in an up-down direction Z. The foot length direction Y extends along a heel center HC when the shoe sole 10 is viewed in the up-down direction Z. The up-down direction Z is orthogonal to a ground contact surface 101 (described later). The heel center HC extends along a straight line that connects: the center of a heel bone of a standard wearer of the shoe 1 having the shoe sole 10; and a point between the third toe and the fourth toe of the wearer, when viewed in the up-down direction Z.

Figure 3:
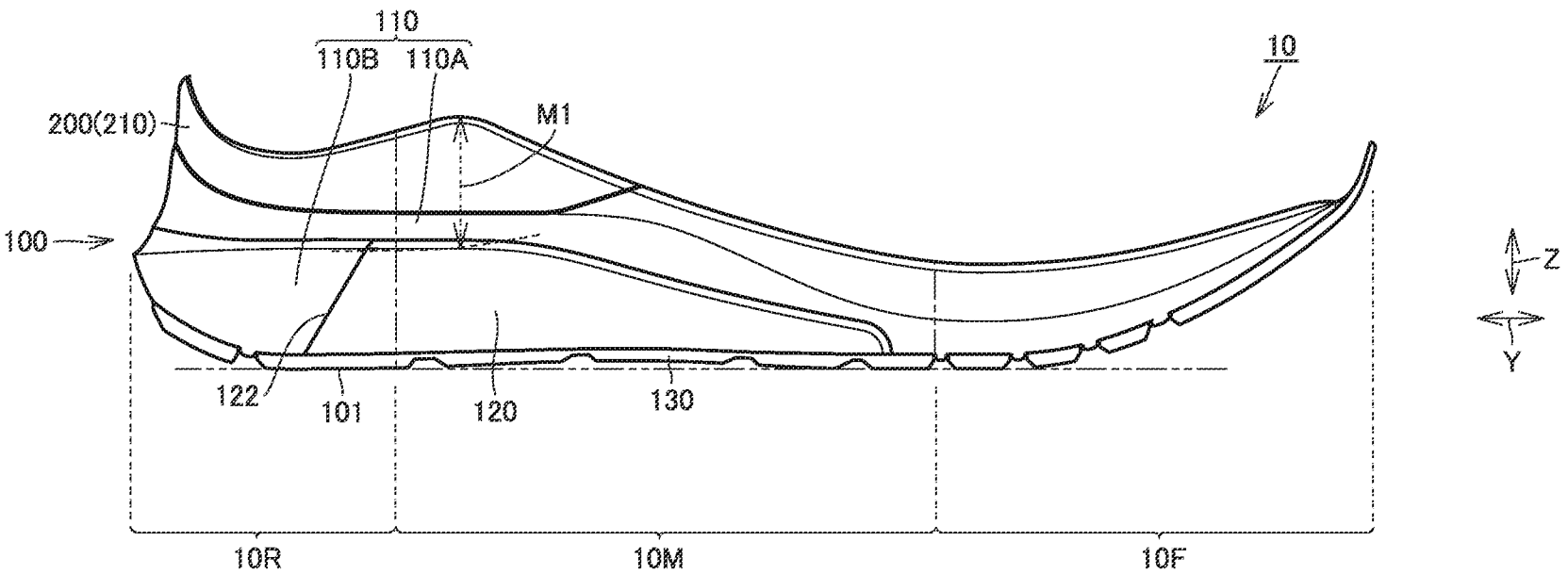
FIG. 3 is a side view of the shoe sole according to one embodiment of the present invention, when seen from a medial foot side.
Figure 4:
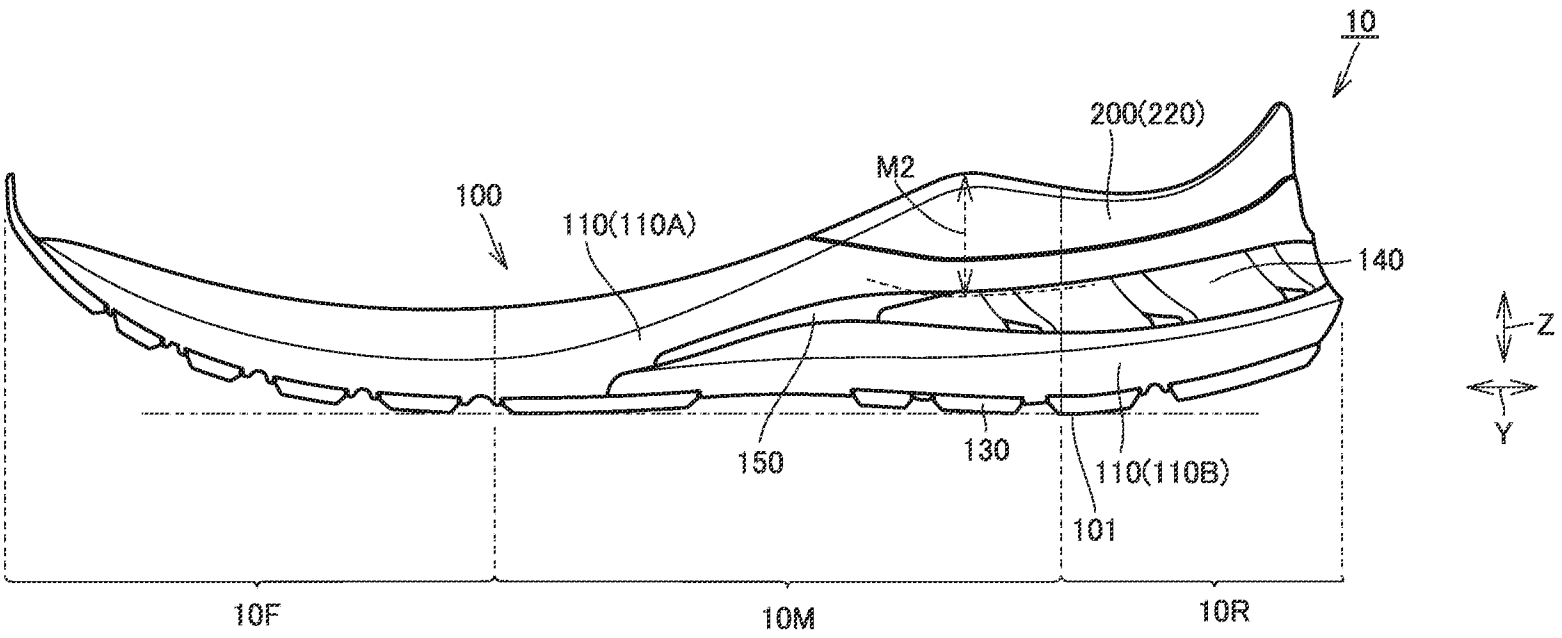
FIG. 4 is a side view of the shoe sole according to one embodiment of the present invention, when seen from a lateral foot side.
Figure 5:
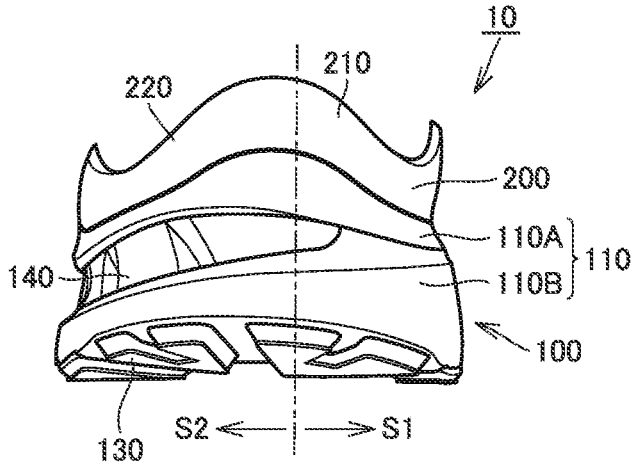
FIG. 5 is a rear view of the shoe sole according to one embodiment of the present invention, when seen from a rear end side.

FIG. 3 is a side view of the shoe sole according to one embodiment of the present invention, when seen from a medial foot side. FIG. 4 is a side view of the shoe sole according to one embodiment of the present invention, when seen from a lateral foot side. FIG. 5 is a rear view of the shoe sole according to one embodiment of the present invention, when seen from a rear end side. As used herein, the medial foot side means a medial side of the foot in anatomical position (that is, a side closer to the median), and the lateral foot side means a side opposite to a medial side of the foot in anatomical position (that is, a side farther from the median).

As shown in FIGS. 3 to 5, the shoe sole 10 includes a body portion 100 and a heel holding portion 200. The body portion 100 has a ground contact surface 101. The heel holding portion 200 is located opposite to a ground contact surface 101 of the body portion 100, and holds a heel portion of a foot at least from a medial foot side 1. In the present embodiment, the heel holding portion 200 holds the heel portion of the foot also from a lateral foot side S2.

Figure 6:
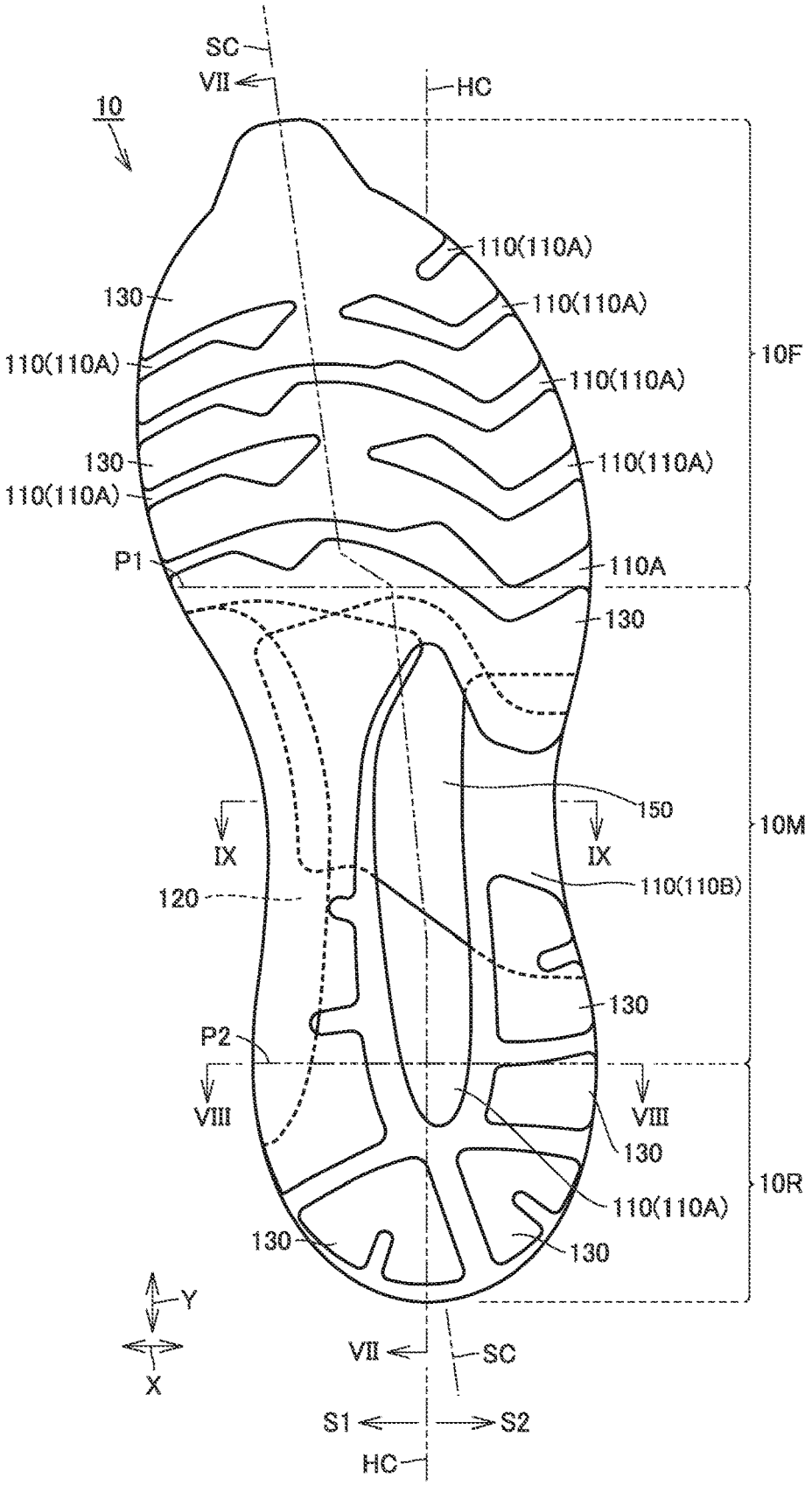
FIG. 6 is a bottom view of the shoe sole according to one embodiment of the present invention, when seen from below.
Figure 7:
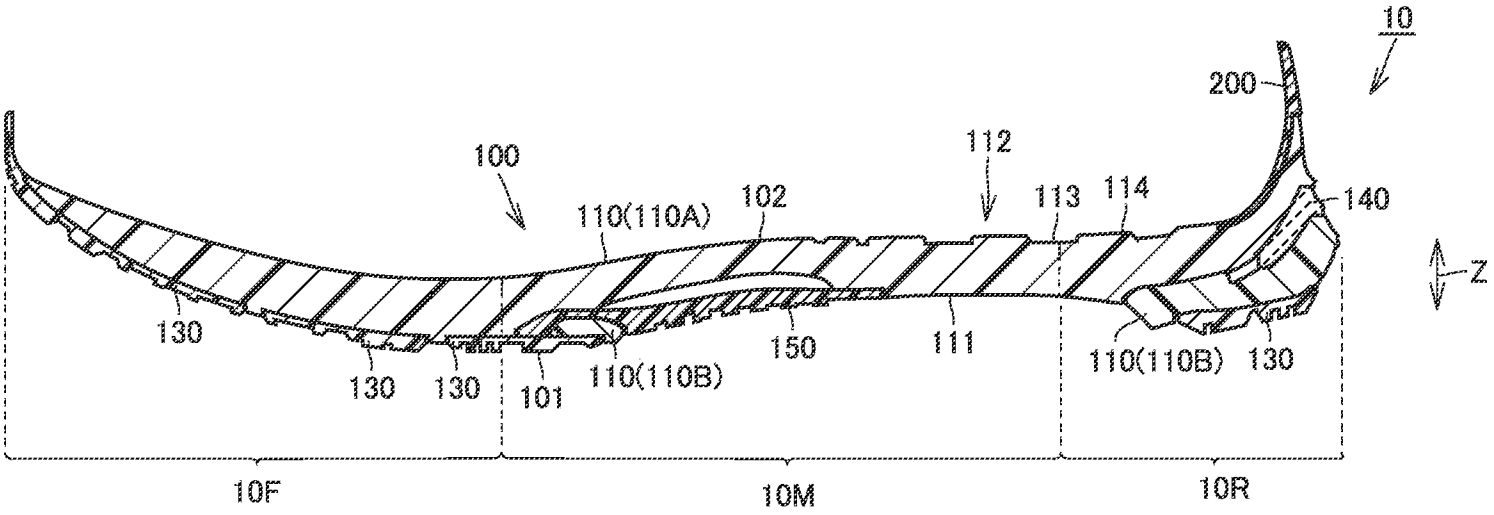
FIG. 7 is a cross-sectional view of the shoe sole in FIG. 6, when seen in a direction indicated by an arrow VII-VII.
Figure 8:
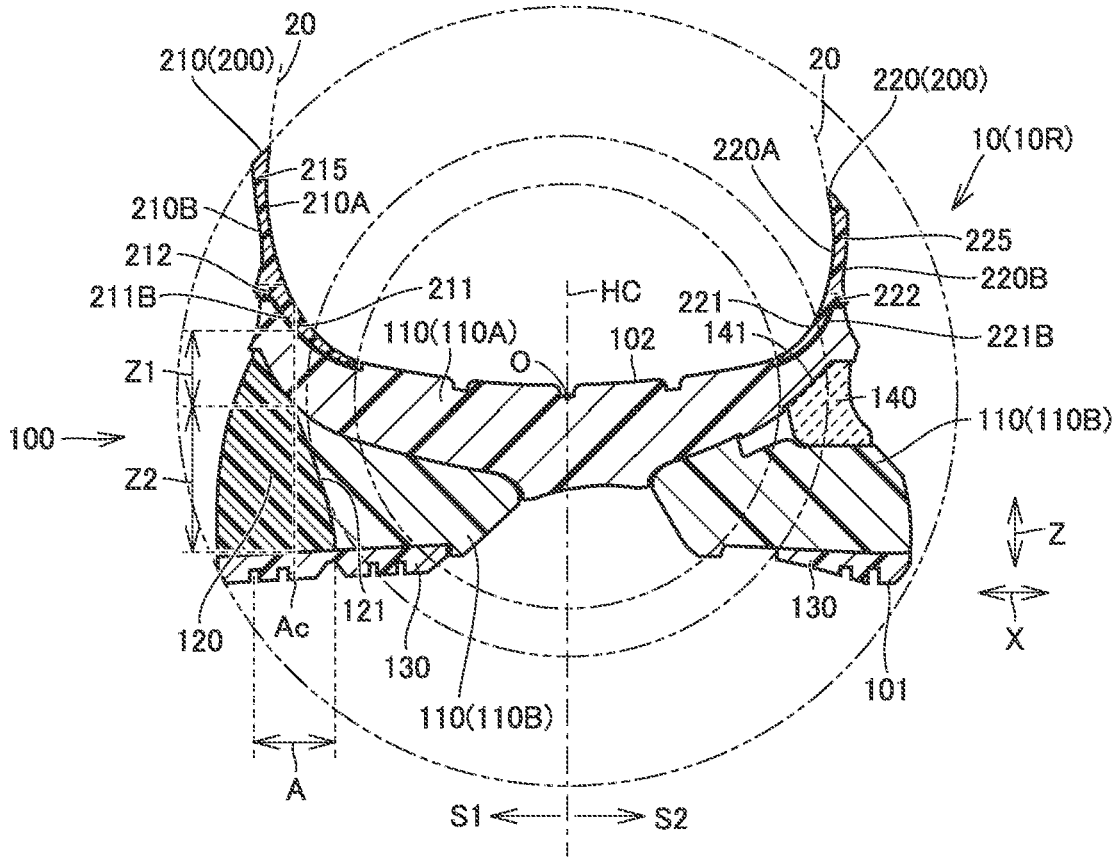
FIG. 8 is a cross-sectional view of the shoe sole in FIG. 6, when seen in a direction indicated by an arrow VIII-VIII.

FIG. 6 is a bottom view of the shoe sole according to one embodiment of the present invention, when seen from below. FIG. 7 is a cross-sectional view of the shoe sole in FIG. 6, when seen in the direction indicated by an arrow VII-VII. FIG. 8 is a cross-sectional view of the shoe sole in FIG. 6, when seen in the direction indicated by an arrow VIII-VIII.

As shown in FIGS. 3 to 8, in the present embodiment, the body portion 100 includes a low hardness portion 110, a high hardness portion 120, an outsole 130, a shock absorbing member 140, and a reinforcing member 150. If desired, the body portion 100 does not necessarily include the shock absorbing member 140 or does not necessarily include the reinforcing member 150.

As shown in FIGS. 6 and 7, the low hardness portion 110 is continuously disposed in the front foot portion 10F, the middle foot portion 10M, and the rear foot portion 10R in the foot length direction Y. In the present embodiment, a lower surface 111 of the low hardness portion 110 does not form the ground contact surface 101 of the body portion 100, but a part of lower surface 111 can form the ground contact surface 101. The upper surface of the low hardness portion 110 forms an upper surface 102 of the body portion 100.

The upper surface of the low hardness portion 110 has a shock absorbing region 112. The shock absorbing region 112 extends from the rear foot portion 10R to the middle foot portion 10M. The shock absorbing region 112 is located so as not to overlap with the heel holding portion 200 when viewed in the up-down direction Z.

A mesh-like recessed portion 113 is formed in the shock absorbing region 112. A plurality of protruding portions 114 surrounded by the mesh-like recessed portion 113 are formed in the shock absorbing region 112. The plurality of protruding portions 114 can reduce the impact transmitted to the heel portion of a wearer when the shoe sole hits the ground. The upper surface of the low hardness portion 110 does not necessarily have the shock absorbing region 112.

In the present embodiment, the low hardness portion 110 has an upper portion 110A and a lower portion 110B located below the upper portion 110A. In the present embodiment, the upper portion 110A and the lower portion 110B are formed from different materials, but can be the same material.

As shown in FIGS. 6 and 7, the upper portion 110A is continuously disposed in the front foot portion 10F, the middle foot portion 10M, and the rear foot portion 10R in the foot length direction Y. The lower portion 110B has a substantially U-shaped outline so as to extend along the peripheral edge of the shoe sole 10 in the middle foot portion 10M and the rear foot portion 10R, when viewed in the up-down direction Z. As shown in FIGS. 6 and 8, the lower portion 110B is located at the second boundary position P2 on the medial foot side S1 and the lateral foot side S2 so as to be spaced apart from each other. As shown in FIGS. 3 and 6, the lower portion 110B is not exposed to the outside in the middle foot portion 10M when the shoe sole 10 is viewed from the medial foot side S1.

The low hardness portion 110, i.e., the upper portion 110A and the lower portion 110B, each are made of a foam material. The foam material of the lower portion 110B is preferably harder than the foam material of the upper portion 110A in terms of stability, but can have the same hardness as that of the foam material of the upper portion 110A or can be softer than the foam material of the upper portion 110A.

The foam material of the low hardness portion 110 is formed from a resin or rubber, for example. The foam material formed from a resin can contain: a resin material as a main component; and a foaming agent, a crosslinking agent and the like as sub-components. Examples of the resin material that can be suitably used are a thermoplastic resin such as ethylene-vinyl acetate copolymer (EVA), thermoplastic polyurethane (TPU), or thermoplastic polyamide elastomer (TPA). The foam material formed from rubber can contain a rubber material as a main component; and a plasticizer, a foaming agent, a reinforcing agent, and a crosslinking agent as sub-components. As the rubber material, for example, butadiene rubber can be suitably used.

The hardness of the low hardness portion 110 is preferably 20 degrees or more, and more preferably 40 degrees or more, for example, in Asker C hardness. Further, the hardness of the low hardness portion 110 is preferably 70 degrees or less, and more preferably 60 degrees or less, for example, in Asker C hardness. The low hardness portion 110 having a hardness of 70 degrees or less in Asker C hardness enables a further improved fit to the foot of the wearer of the shoe 1 having the shoe sole 10.

As shown in FIGS. 6 and 8, the high hardness portion 120 is located opposite to the heel holding portion 200, when viewed from the low hardness portion 110. In the present embodiment, the high hardness portion 120 is in direct contact with the low hardness portion 110.

As shown in FIGS. 3 and 6, in the present embodiment, the high hardness portion 120 is located so as to extend in the foot length direction Y from the rear foot portion 10R to the middle foot portion 10M of the shoe sole 10, when viewed in the up-down direction Z. The high hardness portion 120 is exposed to the outside of the shoe sole 10 on the medial foot side S1. The high hardness portion 120 has a rear end face 122 that is in contact with the low hardness portion 110 when seen from the medial foot side S1. The rear end face 122 is inclined downward in the rearward direction.

As shown in FIG. 8, the high hardness portion 120 is located below the low hardness portion 110 located on the medial foot side S1. In the present embodiment, the high hardness portion 120 is located on the side opposite to the center of the shoe sole 10 in the foot width direction X when viewed from the lower portion 110B of the low hardness portion 110 that is located on the medial foot side S1.

When the second boundary position P2 is viewed in the foot length direction Y, on a center line Ac of a region A in the foot width direction where the low hardness portion 110, the high hardness portion 120, and the heel holding portion 200 are aligned in the up-down direction Z, a dimension Z1 of the low hardness portion 110 in the up-down direction Z is preferably 20% or more, and more preferably 30% or more, of a dimension Z2 of the high hardness portion 120 in the up-down direction Z. Also, on the center line Ac in the foot width direction, the dimension Z1 is preferably 50% or less, and more preferably 45% or less, of the dimension Z2 of the high hardness portion 120 in the up-down direction Z. Further, when the second boundary position P2 is viewed in the foot length direction Y, the high hardness portion 120 is spaced apart at a distance from a point O at which the center of the shoe sole 10 in foot width direction X (that is, heel center HC) intersects with the upper surface 102 of the low hardness portion 110, such that the distance is 60% or more of a radius of an imaginary circle circumscribing the shoe sole 10 centered on the point O.

The high hardness portion 120 is formed from a foam material harder than the foam material of the low hardness portion 110. The foam material of the high hardness portion 120 can be the same as that of the low hardness portion 110.

The hardness of the high hardness portion 120 is preferably 55 degrees or more and 80 degrees or less, for example, in Asker C hardness. The high hardness portion 120 having a hardness of 55 degrees or more in Asker C hardness further improves the stability of the foot of the wearer wearing the shoe 1 having the shoe sole 10. The hardness of high hardness portion 120 is higher preferably by 8 degrees or more, and more preferably 10 degrees or more, in Asker C hardness than the low hardness portion 110. By providing the low hardness portion 110 lower by 8 degrees or more in Asker C hardness than the high hardness portion 120, the wearer of the shoe 1 having the shoe sole 10 is less likely to feel an upward thrust from the high hardness portion 120 at the time when the shoe sole hits the ground.

As shown in FIGS. 6 to 8, in the present embodiment, the lower surface of the outsole 130 forms the ground contact surface 101 of the body portion 100. FIG. 6 does not show a tread pattern formed on the exposed surface of the outsole 130.

The outsole 130 is disposed on the lower surface 111 of the low hardness portion 110. More specifically, in the rear foot portion 10R including the second boundary position P2, the outsole 130 is disposed on the lower surface 111 of the lower portion 110B in the low hardness portion 110. In the front foot portion 10F, the outsole 130 is disposed on the lower surface 111 of the upper portion 110A in the low hardness portion 110.

The outsole 130 is formed from a material that is higher in Young's modulus and higher in hardness than the foam material of the low hardness portion 110 and the high hardness portion 120, and that is softer than the resin forming the heel holding portion 200. The outsole 130 is formed from rubber, for example, and can contain: a rubber material as a main component; and a plasticizer, a reinforcing agent, a crosslinking agent, and the like as sub-components.

As shown in FIGS. 2 and 4, the shock absorbing member 140 is disposed at least in the rear foot portion 10R on the lateral foot side S2. The shock absorbing member 140 is softer than the low hardness portion 110 and the high hardness portion 120. Thereby, when the shoe sole hits the ground, the heel portion of the foot of the wearer wearing the shoe 1 having the shoe sole 10 is less likely to collapse toward the medial foot side S1. Thus, overpronation can be further suppressed, and the impact that occurs when the shoe sole hits the ground can be mitigated.

As shown in FIG. 2, the shock absorbing member 140 extends along the outer peripheral edge of the shoe sole 10 when viewed in the up-down direction Z. When viewed in the up-down direction Z, the shock absorbing member 140 is located across the middle foot portion 10M and the rear foot portion 10R on the lateral foot side S2, and extends to the rear end of shoe sole 10.

As shown in FIGS. 4, 5, 7 and 8, the shock absorbing member 140 is located to be exposed to the outside of the shoe sole 10. The shock absorbing member 140 is located inside the low hardness portion 110 in the up-down direction Z. More specifically, the shock absorbing member 140 is sandwiched between the upper portion 110A and the lower portion 110B in the low hardness portion 110 in the up-down direction Z.

The shock absorbing member 140 contains soft elastomer as a main component. Soft elastomer is a solid and jelly-like viscoelastic material. Soft elastomer is made of a polyurethane-based polymer, a polystyrene-based polymer, a silicone-based resin, or other thermoplastic resins, for example.

Figure 9:
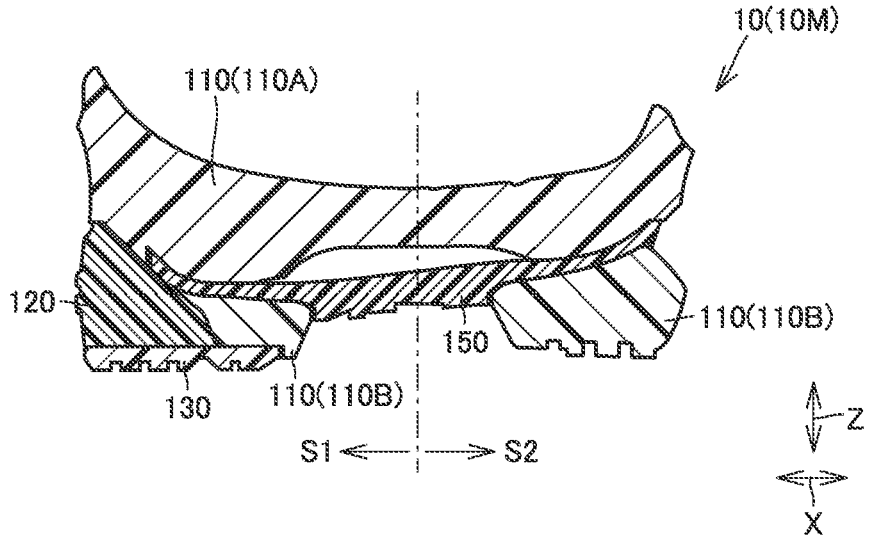
FIG. 9 is a cross-sectional view of the shoe sole in FIG. 6, when seen in a direction indicated by an arrow IX-IX.

FIG. 9 is a cross-sectional view of the shoe sole in FIG. 6, when seen in a direction indicated by an arrow IX-IX. As shown in FIGS. 6 and 9, the reinforcing member 150 is located in the middle foot portion 10M. The reinforcing member 150 is formed from a non-foaming resin harder than each of the foam material of the low hardness portion 110, the foam material of the high hardness portion 120, and the material of the outsole 130. The reinforcing member 150 can suppress sinking of the arch of the foot of the wearer wearing the shoe 1 having the shoe sole 10, when the wearer's foot hits the ground with shoe sole 10.

A part of the reinforcing member 150 is incorporated in the low hardness portion 110. Specifically, the reinforcing member 150 is located to be sandwiched between the upper portion 110A and the lower portion 110B of the low hardness portion 110. The end portion of reinforcing member 150 on the medial foot side S1 in the foot width direction X is located between (upper portion 110A of) the low hardness portion 110 and the high hardness portion 120 in the up-down direction Z.

The resin forming the reinforcing member 150 can be the same as the resin forming the heel holding portion 200.

As shown in FIGS. 2 to 5, the heel holding portion 200 is located in the middle foot portion 10M and the rear foot portion 10R. The heel holding portion 200 extends along the peripheral edge of the shoe sole 10 when viewed in the up-down direction Z. In the present embodiment, the heel holding portion 200 includes a medial foot side holding portion 210 and a lateral foot side holding portion 220. The medial foot side holding portion 210 faces a portion of the peripheral side surface of the heel portion of the foot on the medial foot side S1. The lateral foot side holding portion 220 faces a portion of the peripheral side surface of the heel portion of the foot on the lateral foot side S2. The medial foot side holding portion 210 and the lateral foot side holding portion 220 are connected to each other at the rear end of the shoe sole 10. In the present embodiment, at least at second boundary position P2, the medial foot side holding portion 210 and the lateral foot side holding portion 220 are spaced apart from each other. Further, in the middle foot portion 10M, the medial foot side holding portion 210 and the lateral foot side holding portion 220 are spaced apart from each other.

As shown in FIG. 2, at the second boundary position P2, the medial foot side holding portion 210 is larger in dimension in the foot width direction X than the lateral foot side holding portion 220. In a front-rear direction L, a front end portion 210C of the medial foot side holding portion 210 is located forward of a front end portion 220C of the lateral foot side holding portion 220. The front-rear direction L extends along a center line SC of the shoe sole 10 when the shoe sole 10 is viewed in the up-down direction Z. The center line SC is a straight line connecting the front end and the rear end of the shoe sole 10 when the shoe sole 10 is viewed in the up-down direction Z. The center line SC can be a line corresponding to a straight line connecting the center of a heel bone of a standard wearer wearing the shoe 1 having the shoe sole 10 to a point between the first toe and the second toe of the wearer. In the present embodiment, the front end portion 210C of the medial foot side holding portion 210 is located substantially at the same position as front end portion 220C of the lateral foot side holding portion 220 in the foot length direction Y. The front end portion 210C of the medial foot side holding portion 210 and the front end portion 220C of the lateral foot side holding portion 220 are located substantially at the center of the middle foot portion 10M in the foot length direction Y.

As shown in FIGS. 3 and 4, in the middle foot portion 10M, a maximum dimension M1 of the medial foot side holding portion 210 in the up-down direction Z is larger than a maximum dimension M2 of the lateral foot side holding portion 220 in the up-down direction Z. Further, in the middle foot portion 10M, the average dimension of the medial foot side holding portion 210 in the up-down direction Z is preferably larger than the average dimension of the lateral foot side holding portion 220 in the up-down direction Z. When viewed in the foot width direction X, in the middle foot portion 10M, the upper edge of each of the medial foot side holding portion 210 and the lateral foot side holding portion 220 is curved upward in a protruding shape. When viewed in the foot width direction X, in the rear foot portion 10R, the upper end face of each of the medial foot side holding portion 210 and the lateral foot side holding portion 220 is curved downward in a protruding shape.

As shown in FIG. 8, an inner side surface 210A of the medial foot side holding portion 210 and an inner side surface 220A of the lateral foot side holding portion 220 are joined to the upper portion 20. The average thickness of the medial foot side holding portion 210 from the inner side surface 210A to an outer side surface 210B is larger than the average thickness of the lateral foot side holding portion 220 from the inner side surface 220A to an outer side surface 220B. When viewed in the foot length direction Y, the length in which a medial foot side lower wall portion 211 is joined to the body portion 100 is longer than the length in which a lateral foot side lower wall portion 221 is joined to the body portion 100.

The medial foot side holding portion 210 has a medial foot side lower wall portion 211 and a medial foot side upper wall portion 215.

In the present embodiment, the medial foot side lower wall portion 211 extends in the foot width direction X and is joined to a part of the upper surface 102 of the body portion 100 on the medial foot side S1. The medial foot side lower wall portion 211 has an outer side surface 211B that is inclined downward from an outer end portion 212 of the medial foot side lower wall portion 211 in the foot width direction X toward the center of the shoe sole 10 in the foot width direction X.

The medial foot side upper wall portion 215 extends from the outer end portion 212 of the medial foot side lower wall portion 211 in the foot width direction X to be spaced from the body portion 100.

The lateral foot side holding portion 220 has a lateral foot side lower wall portion 221 and a lateral foot side upper wall portion 225.

The lateral foot side lower wall portion 221 is joined to a part of upper surface 102 of the body portion 100 on the lateral foot side S2. An outer side surface 221B of the lateral foot side lower wall portion 221 is inclined downward from an outer end portion 222 of the lateral foot side lower wall portion 221 in the foot width direction X toward the center of the shoe sole 10 in the foot width direction X.

The lateral foot side upper wall portion 225 extends from the outer end portion 222 of the lateral foot side lower wall portion 221 in foot width direction X to be spaced from the body portion 100.

The following describes details of the positional relation between the heel holding portion 200 and each of members constituting the body portion 100.

As shown in FIG. 8, on the medial foot side S1 in the rear foot portion 10R, the low hardness portion 110 is located between the heel holding portion 200 (medial foot side holding portion 210) and the high hardness portion 120 in the up-down direction Z. In the present embodiment, the low hardness portion 110 is located between the medial foot side holding portion 210 and the high hardness portion 120 in the up-down direction Z. Further, the upper portion 110A of the low hardness portion 110 is located between the heel holding portion 200 (lateral foot side holding portion 220) and the shock absorbing member 140 in the up-down direction Z.

In the present embodiment, in a region of the rear foot portion 10R on the medial foot side S1 where the medial foot side holding portion 210 and the high hardness portion 120 are aligned in the up-down direction Z, an upper surface 121 of the high hardness portion 120 is inclined downward toward the center in the foot width direction X. In this region, the upper surface 121 of the high hardness portion 120 is located along the outer side surface 210B of the medial foot side lower wall portion 211. At the end of the above-mentioned region that is opposite to the center side of the shoe sole 10 in the foot width direction X, the upper surface 121 of the high hardness portion 120 can be parallel to the foot width direction X.

In a region of the rear foot portion 10R on the lateral foot side S2 where the lateral foot side holding portion 220 and the shock absorbing member 140 are aligned in the up-down direction Z, an upper surface 141 of the shock absorbing member 140 is inclined downward toward the center in the foot width direction X. In this region, the upper surface 141 of the shock absorbing member 140 is located along the outer side surface 221B of the lateral foot side lower wall portion 221.

Further, in the present embodiment, when the second boundary position P2 is viewed in the foot length direction Y, the heel holding portion 200 is spaced apart at a distance from point O at which the center of the shoe sole 10 in the foot width direction X intersects with the upper surface 102 of the low hardness portion 110, such that the distance is 50% or more of the radius of the imaginary circle circumscribing the shoe sole 10 centered on point O The heel holding portion 200 is made of a non-foaming resin harder than each of the foam material of the low hardness portion 110 and the foam material of the high hardness portion 120. The resin forming the heel holding portion 200 can contain a resin material as a main component and a crosslinking agent and the like as a sub-component. Examples of the resin material can be a thermoplastic resin and a thermosetting resin. Examples of the thermoplastic resin suitably used in this case can be thermoplastic polyurethane (TPU).

The hardness of heel holding portion 200 is preferably 55 degrees or more and 70 degrees or less, for example, in Asker D hardness. Further, the hardness of the heel holding portion 200 is more preferably 60 degrees or more in Asker D hardness. The heel holding portion 200 having a hardness of 60 degrees or more in Asker D hardness further improves the stability of the foot of the wearer wearing the shoe 1 having the shoe sole 10.

The following describes the functions and effects of the shoe sole 10 according to the present embodiment. During walking or running, a phenomenon called pronation occurs in which the heel portion of the foot falls inward. In pronation, when hitting the ground, the heel portion appropriately falls down toward the medial foot side S1, thereby mitigating the impact applied to the foot when hitting the ground. However, overpronation can occur, in which the heel portion falls down more than necessary toward the medial foot side S1. Overpronation can cause problems with walking or running.

Thus, in the shoe sole 10 according to one embodiment of the present invention, the low hardness portion 110 is formed from a foam material as described above. The high hardness portion 120 is located on the side opposite to the heel holding portion 200 when viewed from the low hardness portion 110. The high hardness portion 120 is made of a foam material that is harder than the foam material of the low hardness portion 110. The heel holding portion 200 is formed from a resin harder than each of the foam material of the low hardness portion 110 and the foam material of the high hardness portion 120. On the medial foot side S1 in the rear foot portion 10R, the low hardness portion 110 is located between the heel holding portion 200 and the high hardness portion 120 in the up-down direction Z.

Thus, when the shoe sole 10 hits the ground, the overpronation of the wearer wearing the shoe 1 having the shoe sole 10 can be suppressed by the high hardness portion 120 and the heel holding portion 200 on the medial foot side S1 of the foot of the wearer, so that stability can be improved. Further, when the shoe sole 10 hits the ground, the low hardness portion 110 is compressed and deformed as appropriate by the high hardness portion 120 and the heel holding portion 200 in the up-down direction Z. Thereby, the low hardness portion 110 can mitigate local impact like an upward thrust applied to the heel portion of the wearer through the high hardness portion 120.

In the present embodiment, the high hardness portion 120 is in direct contact with the low hardness portion 110. When the boundary position (second boundary position P2) between the middle foot portion 10M and the rear foot portion 10R is viewed in the foot length direction Y, on the center line Ac of the region A in the foot width direction where the low hardness portion 110, the high hardness portion 120, and the heel holding portion 200 are aligned in the up-down direction Z, the dimension Z1 of the low hardness portion 110 in the up-down direction Z is 20% or more and 50% or less of dimension Z2 of the high hardness portion 120 in the up-down direction Z. In this way, the dimension Z1 is 20% or more of the dimension Z2 of the high hardness portion 120 in the up-down direction Z, which can appropriately mitigate the impact occurring when the shoe sole 10 hits the ground. Also, the dimension Z1 is 50% or less of the dimension Z2 of the high hardness portion 120 in the up-down direction Z, which can prevent the low hardness portion 110 from reducing the effect of suppressing overpronation.

In the present embodiment, the heel holding portion 200 includes a medial foot side holding portion 210 which faces a portion of the peripheral side surface of the heel portion of the foot on the medial foot side S1. The medial foot side holding portion 210 includes: a medial foot side lower wall portion 211 joined to a part of the upper surface 102 of the body portion 100 on the medial foot side S1; and a medial foot side upper wall portion 215 extending from the outer end portion 212 of the medial foot side lower wall portion 211 in the foot width direction X to be spaced from the body portion 100. This can suppress collapsing of the heel portion of the foot in the foot width direction X at the time when the shoe sole 10 hits the ground, thereby improving stability.

In the present embodiment, the heel holding portion 200 further includes the lateral foot side holding portion 220 which faces a portion of the peripheral side surface of the heel portion of the foot on the lateral foot side S2. The lateral foot side holding portion 220 includes: a lateral foot side lower wall portion 221 joined to a part of upper surface 102 of the body portion 100 on a lateral foot side S2; and a lateral foot side upper wall portion 225 extending from an outer end portion 222 of the lateral foot side lower wall portion 221 in the foot width direction X to be spaced from the body portion 100. This can improve the stationary fit of a foot of a wearer wearing the shoe 1 having the shoe sole 10.

In the present embodiment, at the boundary position (second boundary position P2) between the middle foot portion 10M and the rear foot portion 10R, the medial foot side holding portion 210 is larger in dimension in the foot width direction X than the lateral foot side holding portion 220. This can appropriately improve the stationary fit of a foot of a wearer wearing the shoe 1 having the shoe sole 10, and also can improve the stability by suppressing the collapse of the heel portion of the foot toward the medial foot side S1 in the foot width direction X that occurs when the shoe sole 10 hits the ground.

Further, in the present embodiment, the average thickness of the medial foot side holding portion 210 from the inner side surface 210A to the outer side surface 210B is larger than the average thickness of the lateral foot side holding portion 220 from the inner side surface 220A to the outer side surface 220B. This can appropriately improve the stationary fit of a foot of a wearer wearing the shoe 1 having the shoe sole 10, and can also improve the stability by suppressing the collapse of the heel portion of the foot toward the medial foot side S1 that occurs when the shoe sole 10 hits the ground.

In the present embodiment, in the middle foot portion 10M, the maximum dimension M1 of the medial foot side holding portion 210 in the up-down direction Z is larger than the maximum dimension M2 of the lateral foot side holding portion 220 in the up-down direction Z. This can appropriately improve the stationary fit of a foot of a wearer wearing the shoe 1 having the shoe sole 10, and also can improve the stability by suppressing the collapse of the heel portion of the foot that occurs when the shoe sole 10 hits the ground.

In the present embodiment, the front end portion 210C of the medial foot side holding portion 210 is located forward of the front end portion 220C of the lateral foot side holding portion 220 in the front-rear direction L. This can appropriately improve the stationary fit of a foot of a wearer wearing the shoe 1 having the shoe sole 10, and also can improve the stability by suppressing the collapse of the heel portion of the foot toward the medial foot side S1 that occurs when the shoe sole 10 hits the ground.

In the present embodiment, when viewed in the foot length direction Y, the length in which the medial foot side lower wall portion 211 is joined to the body portion 100 is longer than the length in which the lateral foot side lower wall portion 221 is joined to the body portion 100. This can appropriately improve the stationary fit of a foot of a wearer wearing the shoe 1 having the shoe sole 10, and also can improve the stability by suppressing the collapse of the heel portion of the foot toward the medial foot side S1 that occurs when the shoe sole 10 hits the ground.

In the present embodiment, the outer side surface 211B of the medial foot side lower wall portion 211 is inclined downward from the outer end portion 212 of the medial foot side lower wall portion 211 in the foot width direction X toward the center of the shoe sole 10 in the foot width direction X. In a region of the rear foot portion 10R on the medial foot side S1 where the medial foot side holding portion 210 and the high hardness portion 120 are aligned in the up-down direction Z, the upper surface 121 of the high hardness portion 120 is inclined downward toward the center in the foot width direction X. Thereby, the low hardness portion 110 readily mitigates the impact that occurs when the shoe sole 10 hits the ground and is transmitted from the ground contact surface 101 of the shoe sole 10 on the medial foot side S1 upward toward the center of the shoe sole 10 in the foot width direction X through the high hardness portion 120 and the heel holding portion 200.

Further, in the present embodiment, when the boundary position (second boundary position P2) between the middle foot portion 10M and the rear foot portion 10R is viewed in the foot length direction Y, the heel holding portion 200 is spaced apart at a distance from point O at which the center of the shoe sole 10 in the foot width direction X intersects with the upper surface 102 of the low hardness portion 110, such that the distance is 50% or more of the radius of the imaginary circle circumscribing the shoe sole 10 centering on point O. This can reduce the region in which the heel holding portion 200 overlaps with the wearer's foot when viewed in the up-down direction Z, thereby allowing an improved fit to the bottom portion of the heel portion of the wearer.

In the present embodiment, when the boundary position (second boundary position P2) between the middle foot portion 10M and the rear foot portion 10R is viewed in foot length direction Y, the high hardness portion 120 is spaced apart at a distance from point O at which the center of the shoe sole 10 in the foot width direction X intersects with the upper surface 102 of the low hardness portion 110, such that the distance is 60% or more of the radius of the imaginary circle circumscribing the shoe sole 10 centering on point O. This can reduce the region in which the high hardness portion 120 overlaps with the wearer's foot when viewed in the up-down direction Z, thereby reducing the region that receives an impact transmitted in the up-down direction Z through the high hardness portion 120 when the shoe sole 10 hits the ground. This enables an improved fit on the foot of the wearer.

In the present embodiment, in the region of the rear foot portion 10R on the medial foot side S1 where the medial foot side holding portion 210 and the high hardness portion 120 are aligned in the up-down direction Z, the upper surface 121 of the high hardness portion 120 is located along the outer side surface 210B of the medial foot side wall portion 211. Thereby, the low hardness portion 110 can substantially uniformly mitigate the impact occurring when the shoe sole 10 hits the ground and transmitted from the ground contact surface 101 of the shoe sole 10 on the medial foot side S1 upward toward the center of the shoe sole 10 in the foot width direction X through the high hardness portion 120 and the heel holding portion 200.

Modifications

The following describes a shoe sole according to modifications of one embodiment of the present invention. In the description of a shoe sole according to each of the modifications, the same configuration as that of the shoe sole 10 according to one embodiment of the present invention will not be described.

Figure 10:
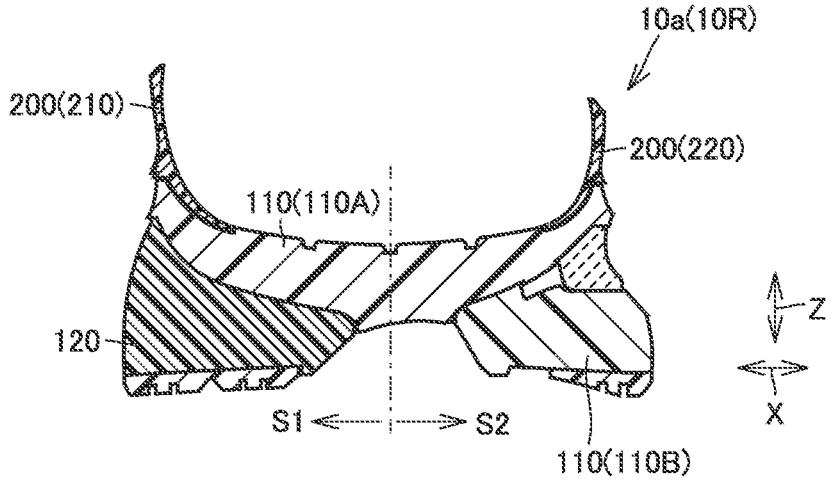
FIG. 10 is a cross-sectional view of a shoe sole according to a first modification of one embodiment of the present invention, when seen from the front at a second boundary position.

FIG. 10 is a cross-sectional view of a shoe sole according to a first modification of one embodiment of the present invention, when seen from the front at the second boundary position. FIG. 10 and FIGS. 11 to 18 (which will be described later) each show a cross-sectional view similar to that of the shoe sole 10 according to one embodiment of the present invention shown in FIG. 8. As shown in FIG. 10, in a shoe sole 10*a* according to the first modification of one embodiment of the present invention, the high hardness portion 120 is located below the upper portion 110A of the low hardness portion 110 entirely on the medial foot side S1 in the foot width direction X, but is not located below the lower portion 110B. Further, the high hardness portion 120 is located closer to the center of the shoe sole 10*a* in the foot width direction X than the medial foot side holding portion 210.

Figure 11:
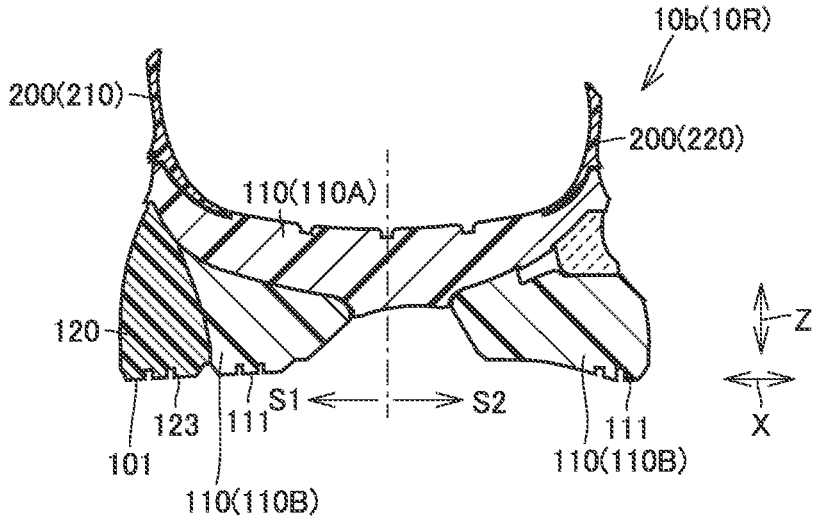
FIG. 11 is a cross-sectional view of a shoe sole according to a second modification of one embodiment of the present invention, when seen from the front at the second boundary position.

FIG. 11 is a cross-sectional view of a shoe sole according to a second modification of one embodiment of the present invention, when seen from the front at the second boundary position. As shown in FIG. 11, a shoe sole 10*b* according to the second modification of one embodiment of the present invention does not include an outsole. In other words, in the shoe sole 10*b*, a lower surface 111 of the low hardness portion 110 and a lower surface 123 of the high hardness portion 120 constitute the ground contact surface 101 of the body portion 100.

Figure 12:
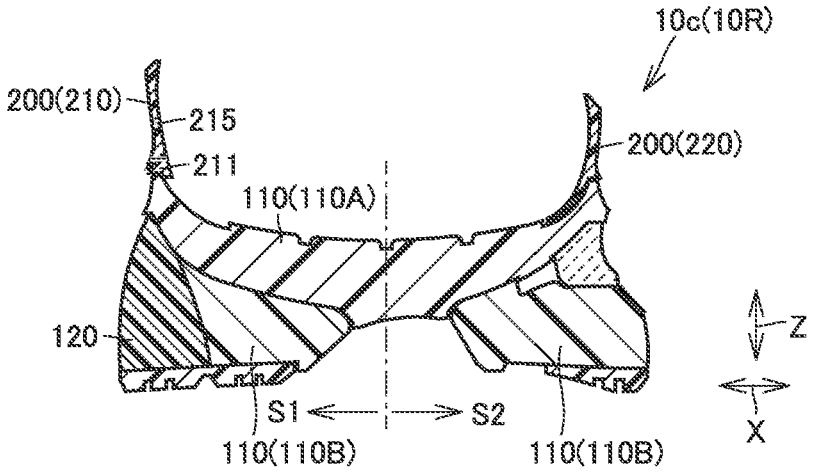
FIG. 12 is a cross-sectional view of a shoe sole according to a third modification of one embodiment of the present invention, when seen from the front at the second boundary position.

FIG. 12 is a cross-sectional view of a shoe sole according to a third modification of one embodiment of the present invention, when seen from the front at the second boundary position. As shown in FIG. 12, in a shoe sole 10*c* according to the third modification of one embodiment of the present invention, the medial foot side lower wall portion 211 of the medial foot side holding portion 210 is located only below the medial foot side upper wall portion 215, but does not extend in the foot width direction X.

Figure 13:
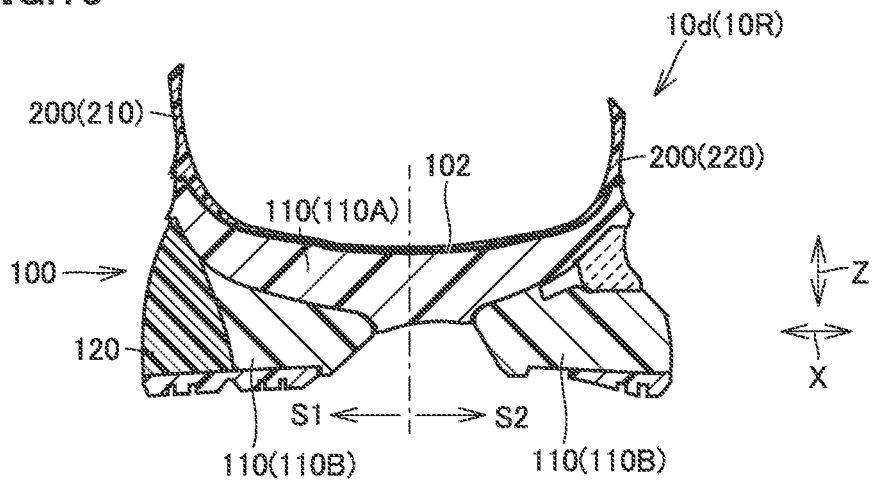
FIG. 13 is a cross-sectional view of a shoe sole according to a fourth modification of one embodiment of the present invention, when seen from the front at the second boundary position.

FIG. 13 is a cross-sectional view of a shoe sole according to a fourth modification of one embodiment of the present invention, when seen from the front at the second boundary position. As shown in FIG. 13, in a shoe sole 10*d* according to the fourth modification of one embodiment of the present invention, the medial foot side holding portion 210 and the lateral foot side holding portion 220 are continuous to each other at the second boundary position P2. In other words, in the shoe sole 10*d* according to the present modification, the heel holding portion 200 covers the entire upper surface 102 of the body portion 100 at the second boundary position P2.

Figure 14:
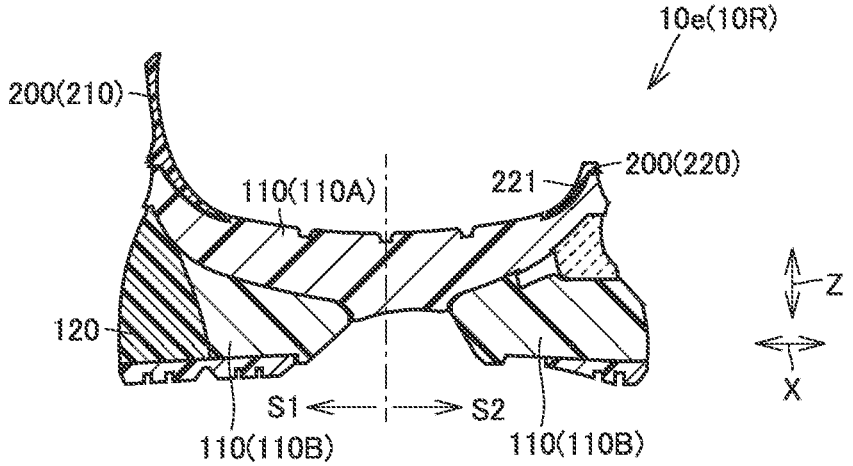
FIG. 14 is a cross-sectional view of a shoe sole according to a fifth modification of one embodiment of the present invention, when seen from the front at the second boundary position.

FIG. 14 is a cross-sectional view of a shoe sole according to a fifth modification of one embodiment of the present invention, when seen from the front at the second boundary position. As shown in FIG. 14, in a shoe sole 10*e* according to the fifth modification of one embodiment of the present invention, the lateral foot side holding portion 220 includes only the lateral foot side lower wall portion 221 but does not include a lateral foot side upper wall portion.

Figure 15:
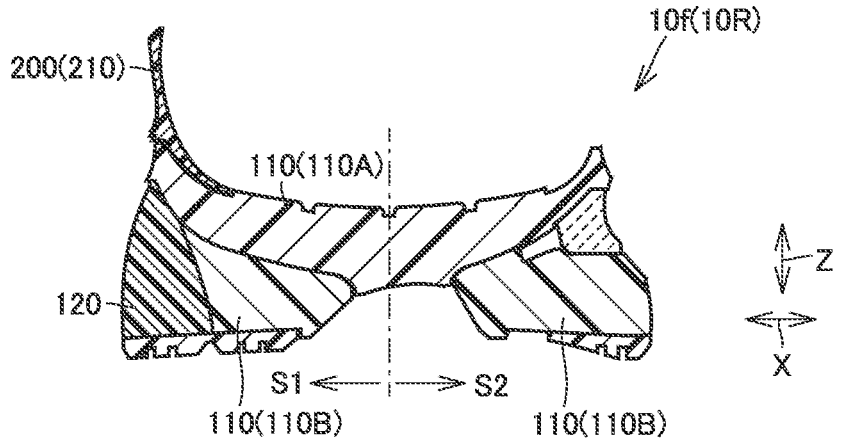
FIG. 15 is a cross-sectional view of a shoe sole according to a sixth modification of one embodiment of the present invention, when seen from the front at the second boundary position.

FIG. 15 is a cross-sectional view of a shoe sole according to a sixth modification of one embodiment of the present invention, when seen from the front at the second boundary position. As shown in FIG. 15, in a shoe sole 10*f* according to the sixth modification of one embodiment of the present invention, the heel holding portion 200 includes only the medial foot side holding portion 210, but does not include a lateral foot side holding portion.

Figure 16:
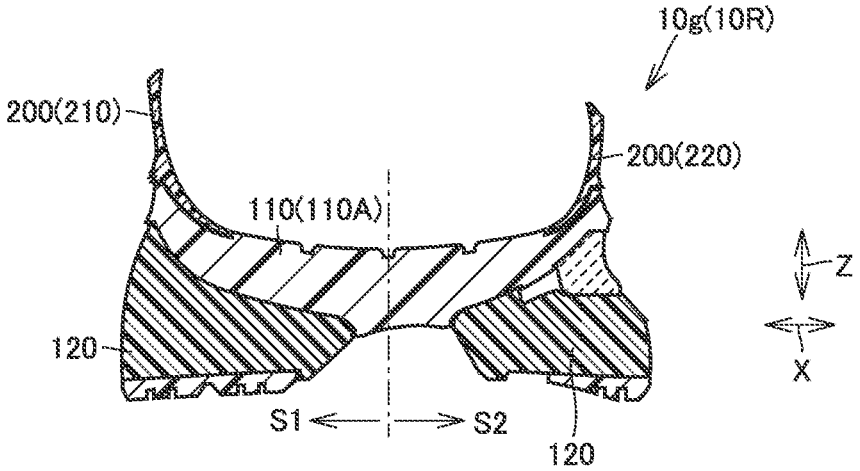
FIG. 16 is a cross-sectional view of a shoe sole according to a seventh modification of one embodiment of the present invention, when seen from the front at the second boundary position.

FIG. 16 is a cross-sectional view of a shoe sole according to a seventh modification of one embodiment of the present invention, when seen from the front at the second boundary position. As shown in FIG. 16, in a shoe sole 10*g* according to a seventh modification of one embodiment of the present invention, the high hardness portion 120 is disposed in place of the lower portion 110B of the low hardness portion 110 in the shoe sole 10 according to one embodiment of the present invention. In other words, in the present modification, also on the lateral foot side S2, the high hardness portion 120 is located opposite to the heel holding portion 200 when viewed from the low hardness portion 110.

Figure 17:
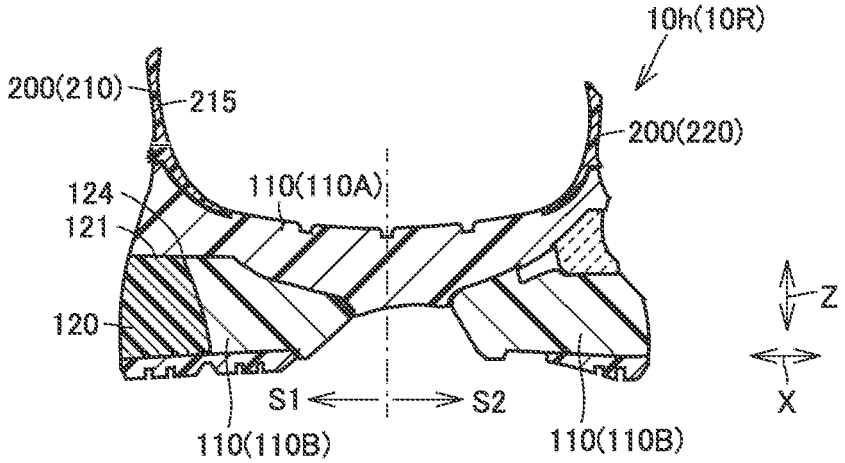
FIG. 17 is a cross-sectional view of a shoe sole according to an eighth modification of one embodiment of the present invention, when seen from the front at the second boundary position.

FIG. 17 is a cross-sectional view of a shoe sole according to an eighth modification of one embodiment of the present invention, when seen from the front at the second boundary position. As shown in FIG. 17, in a shoe sole 10*h* according to the eighth modification of one embodiment of the present invention, the upper surface 121 of the high hardness portion 120 is bent at a corner portion 124 when viewed in the foot length direction Y. When viewed in the foot length direction Y, at the second boundary position P2, the corner portion 124 is located closer to the center of the shoe sole 10 than the medial foot side upper wall portion 215 of the medial foot side holding portion 210 in the foot width direction X. A portion of the upper surface 121 that is located opposite to the center side of the shoe sole 10 when viewed from corner the portion 124 extends in the foot width direction X.

Figure 18:
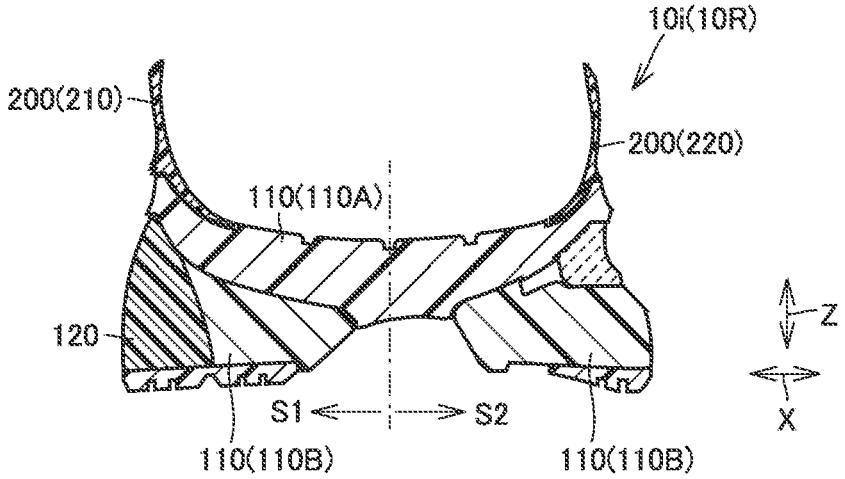
FIG. 18 is a cross-sectional view of a shoe sole according to a ninth modification of one embodiment of the present invention, when seen from the front at the second boundary position.

FIG. 18 is a cross-sectional view of a shoe sole according to a ninth modification of one embodiment of the present invention, when seen from the front at the second boundary position. As shown in FIG. 18, in a shoe sole 10*i* according to the ninth modification of one embodiment of the present invention, at the second boundary position P2, the dimension of the lateral foot side holding portion 220 in the up-down direction Z is substantially the same as the dimension of the medial foot side holding portion 210 in the up-down direction Z.

Figure 19:
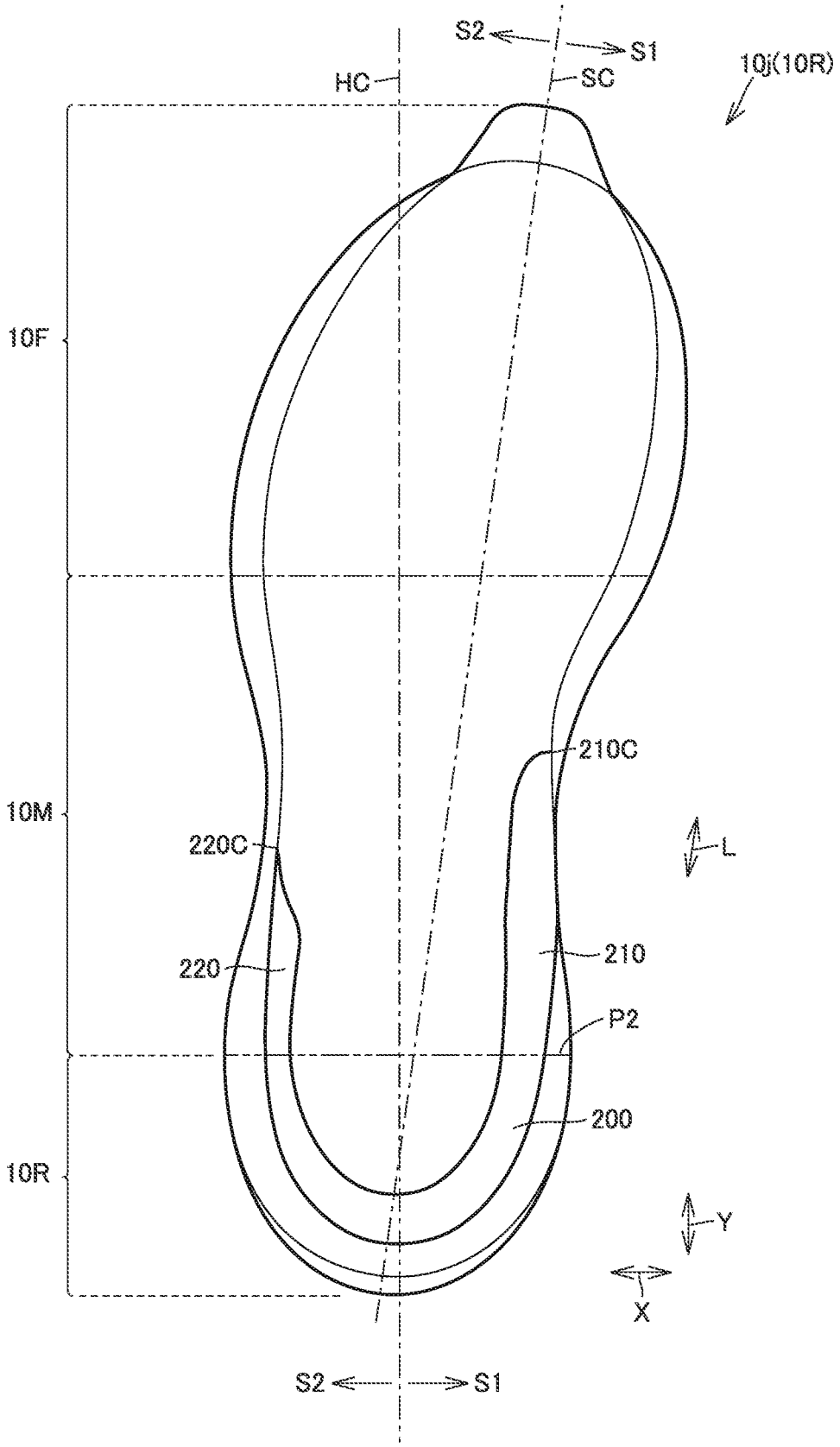
FIG. 19 is a plan view of a shoe sole according to a tenth modification of one embodiment of the present invention, when seen from above.

FIG. 19 is a plan view of a shoe sole according to a tenth modification of one embodiment of the present invention, when seen from above. As shown in FIG. 19, in a shoe sole 10*j* according to the tenth modification of one embodiment of the present invention, also in the foot length direction Y, the front end portion 210C of the medial foot side holding portion 210 is located forward of the front end portion 220C of the lateral foot side holding portion 220. Further, in the foot length direction Y, the front end portion 220C of the lateral foot side holding portion 220 is located forward of the center of the middle foot portion 10M.

Figure 20:
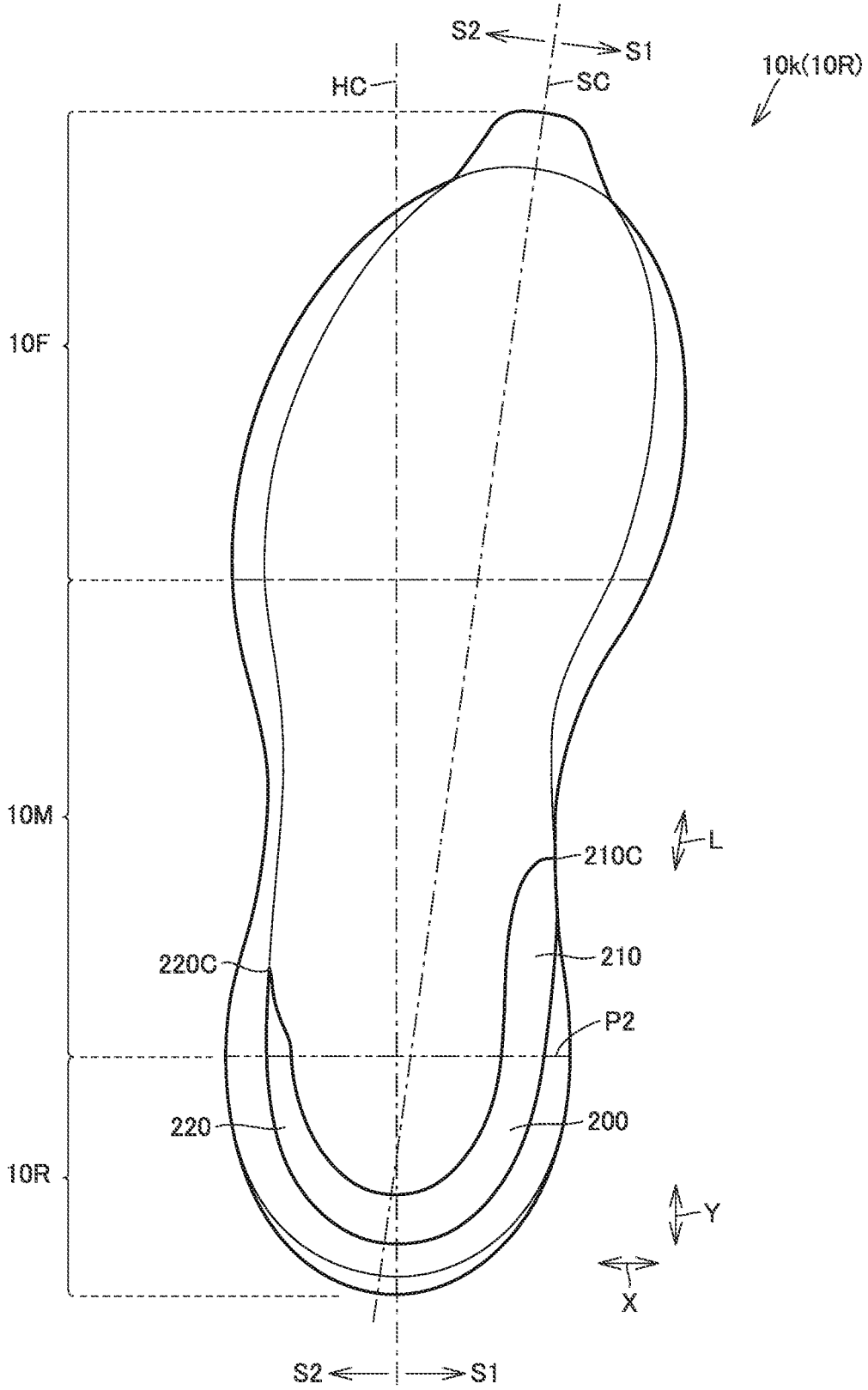
FIG. 20 is a plan view of a shoe sole according to an eleventh modification of one embodiment of the present invention, when seen from above.

FIG. 20 is a plan view of a shoe sole according to an eleventh modification of one embodiment of the present invention, when seen from above. As shown in FIG. 20, also in a shoe sole 10*k* according to the eleventh modification of one embodiment of the present invention, in the foot length direction Y, the front end portion 210C of the medial foot side holding portion 210 is located forward of the front end portion 220C of the lateral foot side holding portion 220. Further, in the foot length direction Y, the front end portion 210C of the medial foot side holding portion 210 is located rearward of the center of the middle foot portion 10M.

Figure 21:
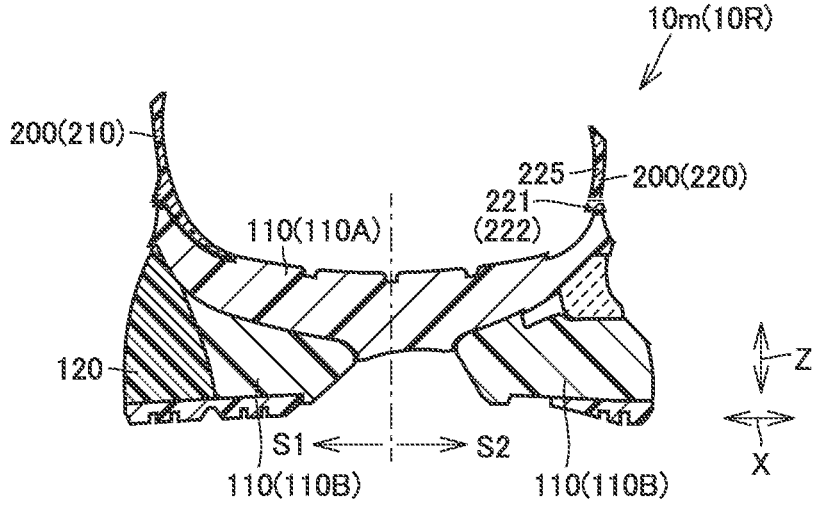
FIG. 21 is a cross-sectional view of a shoe sole according to a twelfth modification of one embodiment of the present invention, when seen from the front at the second boundary position.
Figure 22:
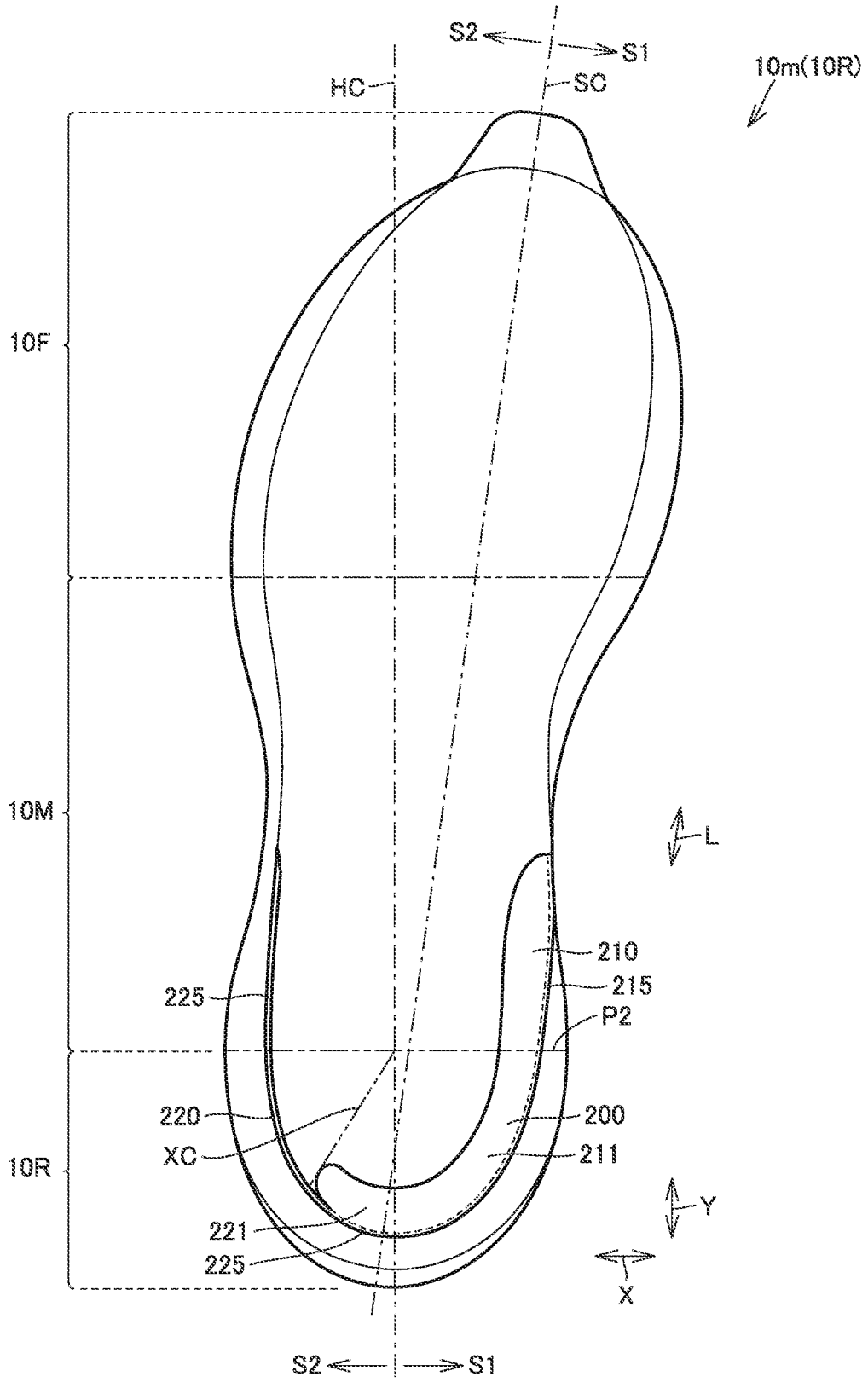
FIG. 22 is a plan view of a shoe sole according to a twelfth modification of one embodiment of the present invention, when seen from above.

FIG. 21 is a cross-sectional view of a shoe sole according to a twelfth modification of one embodiment of the present invention, when seen from the front at the second boundary position. FIG. 22 is a plan view of a shoe sole according to the twelfth modification of one embodiment of the present invention, when seen from above. As shown in FIGS. 21 and 22, in a shoe sole 10*m* according to the twelfth modification of one embodiment of the present invention, at the second boundary position P2, the lateral foot side lower wall portion 221 is located only below the lateral foot side upper wall portion 225, but does not extend from the outer end portion 222 in the foot width direction X. More specifically, in the entire middle foot portion 10M, the lateral foot side lower wall portion 221 is located only below the lateral foot side upper wall portion 225, but does not extend from the outer end portion 222 in the foot width direction X. In the present modification, the lateral foot side upper wall portion 225 facilitates tension to act on the upper portion 20, thereby allowing an improved fit on the foot of the wearer. Further, since the lateral foot side lower wall portion 221 is located in the middle foot portion 10M as described above, overpronation of the wearer can be further suppressed.

Figure 23:
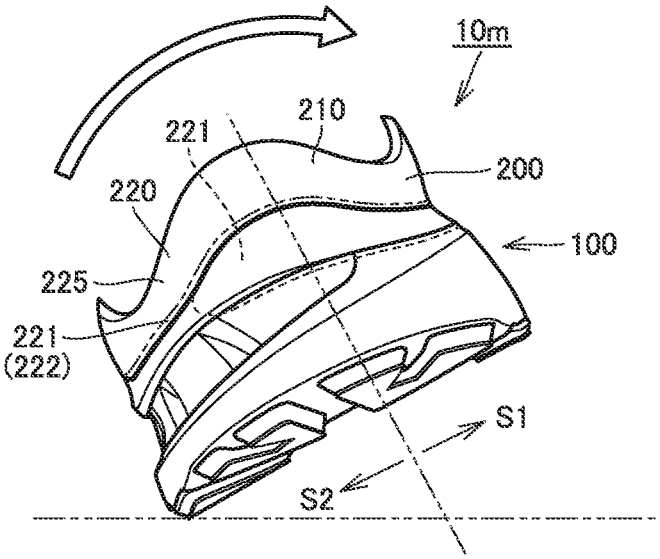
FIG. 23 is a rear view of the shoe sole according to the twelfth modification of one embodiment of the present invention, showing a first stage in which the shoe sole hits the ground when seen from a rear end side.

The following further describes the mechanism by which overpronation can be further suppressed in embodiments of the present modification. FIG. 23 is a rear view of the shoe sole according to the twelfth modification of one embodiment of the present invention, showing a first stage in which the shoe sole hits the ground when seen from a rear end side. As shown in FIG. 23, in the first stage in which a wearer wearing the shoe 1 having the shoe sole 10*m* hits the ground with the shoe sole 10*m*, the shoe sole 10*m* contacts the ground in the state where the shoe sole 10*m* collapses toward the lateral foot side S2 together with the wearer's foot. Immediately after such a contact with the ground, the wearer's foot (not shown) collapses toward the medial foot side S1 as indicated by a white arrow in FIG. 23. At this time, if the lateral foot side lower wall portion 221 extends in the foot width direction X from the outer end portion 222 in the middle foot portion 10M, the lateral foot side lower wall portion 221 is pressed downward by the wearer's foot that is collapsing toward the medial foot side S1. When the lateral foot side lower wall portion 221 is pressed downward, a moment acts to cause the lateral foot side holding portion 220 to entirely collapse toward the medial foot side S1. Due to this moment, the lateral foot side upper wall portion 225 presses the wearer's foot toward the medial foot side S1. The lateral foot side upper wall portion 225 presses the wearer's foot, thereby accelerating the collapse of the wearer's foot toward the medial foot side S1. When the shoe sole on the medial foot side S1 hits the ground in the state where the collapse of the wearer's foot toward the medial foot side S1 is accelerated, overpronation can occur due to a large inertial force of the foot that is collapsing. However, in the present modification, the lateral foot side lower wall portion 221 is located only below the lateral foot side upper wall portion 225 in the entire middle foot portion 10M. Thus, the wearer's foot that is collapsing toward the medial foot side S1 suppresses the lateral foot side lower wall portion 221 from being pressed downward. Accordingly, the above-mentioned moment is less likely to occur in the lateral foot side holding portion 220, thereby also suppressing the acceleration of the collapse of the wearer's foot toward the medial foot side S1. This reduces the inertial force that occurs when the wearer's foot collapses toward the medial foot side S1, so that overpronation can be further suppressed.

As shown in FIGS. 22 and 23, in a part of the lateral foot side holding portion 220 that is connected to the medial foot side holding portion 210 at the rear end of the shoe sole 10*m*, the lateral foot side lower wall portion 221 can extend from the outer end portion 222 in the foot width direction X. In this embodiment, the lateral foot side lower wall portion 221 is disposed so as to be continuous to the medial foot side lower wall portion 211 at the rear end of the shoe sole 10*m*. Further, when viewed in the up-down direction Z, the lateral foot side lower wall portion 221 can be located at a position even slightly closer to the region on the lateral foot side S2 than the position at which the heel holding portion 200 intersects with the center line SC or the heel center HC. More specifically, when viewed in the up-down direction Z, a part of the lateral foot side lower wall portion 221 that is continuous to the medial foot side lower wall portion 211 at the rear end of the shoe sole 10*m* is located in a rearward region of two regions defined by the heel center HC and an imaginary line XC, but is not located in a forward region of the two regions. The imaginary line XC is an imaginary straight line that extends rearward on the lateral foot side S2 from an intersection point between the second boundary position P2 and the heel center HC, when viewed in the up-down direction Z. The angle formed between the heel center HC and the imaginary line XC is less than ½ of the angle formed between the heel center HC and the second boundary position P2.

In each of the above-described modifications, the low hardness portion 110 is made of a foam material. The high hardness portion 120 is located opposite to the heel holding portion 200 when viewed from the low hardness portion 110. The high hardness portion 120 is made of a foam material that is harder than the foam material of the low hardness portion 110. The heel holding portion 200 is made of a resin harder than each of the foam material of the low hardness portion 110 and the foam material of the high hardness portion 120. On the medial foot side S1 in the rear foot portion 10R, the low hardness portion 110 is located between the heel holding portion 200 and the high hardness portion 120 in the up-down direction Z. Thus, when the shoe sole hits the ground, overpronation can be suppressed by the high hardness portion 120 and the heel holding portion 200 to thereby improve the stability of the foot, and also, local impact transmitted to the heel portion of the wearer of the shoe through the high hardness portion 120 can be mitigated by the low hardness portion 110.

Although embodiments of the present invention have been described and illustrated in detail, it is clearly understood that the same is by way of illustration and example only and is not to be taken by way of limitation, the scope of the present invention being interpreted by the terms of the appended claims.

What is claimed is:

1. A shoe sole comprising:

a front foot portion configured to support a toe portion and a ball portion of a foot;

a middle foot portion configured to support an arch portion of the foot;

a rear foot portion configured to support a heel portion of the foot, the front foot portion, the middle foot portion, and the rear foot portion being connected in a foot length direction;

a body portion having a ground contact surface; and a heel holding portion located opposite to the ground contact surface of the body portion and configured to hold the heel portion of the foot at least from a medial foot side, the body portion including a first low hardness portion being a foam material, a second low hardness portion, a third low hardness portion, and a high hardness portion being a foam material harder than the foam material of the first low hardness portion, the heel holding portion being a resin that is harder than both the foam material of the first low hardness portion and the foam material of the high hardness portion, on the medial foot side in the rear foot portion, the first low hardness portion being disposed between the heel holding portion and the high hardness portion in an up-down direction, at the rear foot portion, the heel holding portion is spaced apart in a vertical direction from the high hardness portion with the first low hardness portion being disposed therebetween, the second low hardness portion being disposed laterally adjacent the high hardness portion and below the first low hardness portion, the third low hardness portion being disposed laterally adjacent and spaced from the second low hardness portion so as to form a gap between the second low hardness portion and the third low hardness portion, and the high hardness portion protrudes laterally further outward than the heel holding portion on the medial foot side of the rear foot portion and forms an outer surface of the body portion that extends in the foot length direction from the middle foot portion into contact with the second low hardness portion at a rear end face that is exposed on the medial foot side and is located at the rear foot portion, with the high hardness portion located further outward on the medial foot side than the second low hardness portion, and with the second low hardness portion located further rearward in the foot length direction than the rear end face of the high hardness portion.

2. The shoe sole according to claim 1, wherein the high hardness portion is in direct contact with the first low hardness portion, and at the rear foot portion, the first low hardness portion, the high hardness portion, and the heel holding portion are aligned in the vertical direction and a dimension of the first low hardness portion in the vertical direction is between 20% to 50% of a dimension of the high hardness portion in the vertical direction.

3. The shoe sole according to claim 1, wherein the heel holding portion includes a medial foot side holding portion configured to face a portion of a peripheral side surface of the heel portion of the foot, the portion being located on the medial foot side, and the medial foot side holding portion has a medial foot side lower wall portion joined to a part of an upper surface of the body portion, the part of the upper surface of the body portion being located on the medial foot side, and a medial foot side upper wall portion extending from an outer end portion of the medial foot side lower wall portion in a foot width direction to be spaced from the body portion.

4. The shoe sole according to claim 3, wherein the heel holding portion further includes a lateral foot side holding portion configured to face a portion of the peripheral side surface of the heel portion of the foot, the portion being disposed on a lateral foot side, and the lateral foot side holding portion has a lateral foot side lower wall portion joined to a part of the upper surface of the body portion, the part being disposed on the lateral foot side, and a lateral foot side upper wall portion extending from an outer end portion of the lateral foot side lower wall portion in the foot width direction to be spaced from the body portion.

5. The shoe sole according to claim 4, wherein, at the rear foot portion, the medial foot side holding portion is larger in the foot width direction than the lateral foot side holding portion.

6. The shoe sole according to claim 4, wherein an average thickness of the medial foot side holding portion from an inner side surface to an outer side surface is larger than an average thickness of the lateral foot side holding portion from an inner side surface to an outer side surface.

7. The shoe sole according to claim 4, wherein, in the middle foot portion, the medial foot side holding portion has a larger maximum dimension in the up-down direction than the lateral foot side holding portion.

8. The shoe sole according to claim 4, wherein a front end portion of the medial foot side holding portion is disposed forward of a front end portion of the lateral foot side holding portion in a front-rear direction.

9. The shoe sole according to claim 4, wherein, when viewed in the foot length direction, a length in which the medial foot side lower wall portion is joined to the body portion is longer than a length in which the lateral foot side lower wall portion is joined to the body portion.

10. The shoe sole according to claim 3, wherein an outer side surface of the medial foot side lower wall portion is inclined downward from the outer end portion of the medial foot side lower wall portion in the foot width direction toward a center position of the shoe sole in the foot width direction, and in a region of the rear foot portion on the medial foot side where the medial foot side holding portion and the high hardness portion are aligned in the vertical direction, an upper surface of the high hardness portion is inclined downward toward the center position of the shoe sole in the foot width direction.

11. The shoe sole according to claim 3, wherein at the rear foot portion, the heel holding portion is spaced apart at a distance from a center position of the shoe sole in the foot width direction.

12. The shoe sole according to claim 3, wherein at the rear foot portion, the high hardness portion is spaced apart at a distance from a center position of the shoe sole in the foot width direction.

13. The shoe sole according to claim 3, wherein, in a region of the rear foot portion on the medial foot side where the medial foot side holding portion and the high hardness portion are aligned in the up-down direction, an upper surface of the high hardness portion is located along an outer side surface of the medial foot side lower wall portion.

14. A shoe comprising:

the shoe sole according to claim 1; and an upper portion located above the shoe sole.

15. The shoe sole according to claim 1, wherein the first low hardness portion and the second low hardness portion are formed from different materials.

16. The shoe sole according to claim 15, wherein the first low hardness portion and the third low hardness portion are formed from different materials.

17. The shoe sole according to claim 1, wherein the body portion includes a shock absorber disposed between the first low hardness portion and the third low hardness portion in the vertical direction.

18. A shoe sole comprising:

a front foot portion configured to support a toe portion and a ball portion of a foot;

a middle foot portion configured to support an arch portion of the foot;

a rear foot portion configured to support a heel portion of the foot, the front foot portion, the middle foot portion, and the rear foot portion being connected in a foot length direction;

a body portion having a ground contact surface; and a heel holding portion located opposite to the ground contact surface of the body portion and configured to hold the heel portion of the foot at least from a medial foot side, the body portion including a low hardness portion being a foam material, and a high hardness portion being a foam material harder than the foam material of the low hardness portion, the heel holding portion being a resin that is harder than both the foam material of the low hardness portion and the foam material of the high hardness portion, and having an Asker D hardness between 55 degrees and 70 degrees, on the medial foot side in the rear foot portion, the low hardness portion being disposed between the heel holding portion and the high hardness portion in an up-down direction, the heel holding portion including an inner end portion in the foot width direction, at the rear foot portion, the inner end portion is spaced apart in a vertical direction from the high hardness portion with the low hardness portion being disposed therebetween, and the high hardness portion contacts the low hardness portion at a rear end face that is inclined downward in the rearward direction and exposed when viewed from the medial foot side, wherein the low hardness portion has an Asker C hardness of between 20 degrees and 70 degrees and is located further rearward in the foot length direction than the high hardness portion, the high hardness portion has an Asker C hardness of between 55 degrees and 80 degrees, and the high hardness portion has an Asker C hardness that is at least 8 degrees higher than an Asker C hardness of the low hardness portion.

19. The shoe sole according to claim 18, wherein the heel holding portion has Asker D hardness between 60 degrees and 70 degrees.

20. The shoe sole according to claim 18, wherein the low hardness portion has an Asker C hardness of between 40 degrees and 60 degrees, and the high hardness portion has an Asker C hardness that is at least 10 degrees higher than an Asker C hardness of the low hardness portion.

* * * * *